US010319341B2

(12) United States Patent
Park et al.

(10) Patent No.: US 10,319,341 B2
(45) Date of Patent: Jun. 11, 2019

(54) ELECTRONIC DEVICE AND METHOD FOR DISPLAYING CONTENT THEREOF

(71) Applicant: Samsung Electronics Co., Ltd, Gyeonggi-do (KR)

(72) Inventors: Daekeun Park, Gyeonggi-do (KR); Keehyon Park, Gyeonggi-do (KR); Hunhee Lee, Gyeonggi-do (KR); Sungmin Chu, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 246 days.

(21) Appl. No.: 15/354,973

(22) Filed: Nov. 17, 2016

(65) Prior Publication Data

US 2017/0140733 A1 May 18, 2017

(30) Foreign Application Priority Data

Nov. 17, 2015 (KR) ..... 10-2015-0161067

(51) Int. Cl.
*G09G 5/10* (2006.01)

(52) U.S. Cl.
CPC ..... *G09G 5/10* (2013.01); *G09G 2320/0233* (2013.01); *G09G 2320/0295* (2013.01); *G09G 2320/0626* (2013.01); *G09G 2320/0646* (2013.01); *G09G 2330/021* (2013.01); *G09G 2360/144* (2013.01)

(58) Field of Classification Search
CPC ... G09G 2320/0233; G09G 2320/0295; G09G 2320/0626; G09G 2320/0646; G09G 2330/021; G09G 2360/144; G09G 5/10
See application file for complete search history.

(56) References Cited

U.S. PATENT DOCUMENTS 7,113,164 B1 * 9/2006 Kurihara ..... G09G 3/3413 345/102
7,782,366 B2 * 8/2010 Imai ..... H04N 1/32128 348/207.1
2003/0081141 A1 * 5/2003 Mazzapica ..... H04N 1/40093 348/362
2006/0082849 A1 * 4/2006 Kaku ..... G06K 9/00248 358/537

(Continued)

FOREIGN PATENT DOCUMENTS

JP 11136571 5/1999
JP 2009251066 10/2009
KR 20120113050 10/2012

*Primary Examiner* — Dmitriy Bolotin

(57) ABSTRACT

According to one embodiment of the present disclosure, an electronic device may include a display and a processor electrically connected to the display. The processor may be configured to classify a frame of content that is being reproduced on the display into a plurality of blocks including at least one pixel, confirm average brightness values of each of the plurality of blocks, determine whether to satisfy at least one specified condition based on the average brightness values of at least some of the plurality of blocks, and adjust brightness of the at least one pixel included in the plurality of blocks if it is determined that the at least one specified condition is satisfied. Other various embodiments may be directed to an electronic device or a method of display content of an electronic device.

20 Claims, 15 Drawing Sheets

(56) References Cited

U.S. PATENT DOCUMENTS

| | | | | |
|---|---|---|---|---|
| 2006/0164407 | A1* | 7/2006 | Cok | G09G 3/20 345/204 |
| 2008/0158410 | A1* | 7/2008 | Lin | H04N 5/235 348/364 |
| 2009/0115718 | A1* | 5/2009 | Qiao | G09G 3/3426 345/102 |
| 2012/0045143 | A1* | 2/2012 | Kim | G06T 5/20 382/260 |
| 2012/0154659 | A1* | 6/2012 | Wang | H04N 9/3182 348/333.1 |
| 2014/0064613 | A1* | 3/2014 | Wu | G06T 5/002 382/167 |

* cited by examiner

FIG. 6A

610

| | | | | | | |
|---|---|---|---|---|---|---|
| 65 | 65 | 65 | 65 | 65 | 65 | 65 |
| 65 | 65 | 65 | 65 | 65 | 65 | 65 |
| 65 | 65 | 65 | 65 | 65 | 65 | 65 |
| 65 | 65 | 65 | 65 | 65 | 65 | 65 |
| 65 | 65 | 65 | 65 | 65 | 65 | 65 |

ELECTRONIC DEVICE AND METHOD FOR DISPLAYING CONTENT THEREOF

CROSS-REFERENCE TO RELATED APPLICATION(S) AND CLAIM OF PRIORITY

The present application is related to and claims the benefit under 35 U.S.C. § 119(a) of Korean patent application filed on Nov. 17, 2015 in the Korean Intellectual Property Office and assigned Serial Number 10-2015-0161067, the entire disclosure of which is hereby incorporated by reference.

TECHNICAL FIELD

Various embodiments of the present disclosure relate to an electronic device capable of controlling brightness of content depending on image information of the content and a method for controlling an operation thereof.

BACKGROUND

Various electronic devices such as a smart phone, a tablet PC, a portable multimedia player (PMP), a personal digital assistant (PDA), a laptop personal computer (PC), and a wearable device may provide various functions (for example, social network service (SNS), internet, multimedia, photograph and performance of photo moving images) as well as a telephone function. In particular, various electronic devices provide a function of reproducing content (for example, media moving image).

Users watch content using an electronic device under various living environments. Accordingly, the electronic device provides a function of automatically or manually controlling brightness of a display depending on the surrounding environment. However, the existing electronic devices may uniformly control the brightness of the display, or the like independent of content.

SUMMARY

To address the above-discussed deficiencies, it is a primary object to provide an electronic device capable of adjusting brightness of content based on image information of the content and a method for displaying content thereof.

Various embodiments of the present disclosure are directed to the provision of an electronic device, comprising: a display and a processor electrically connected to the display, wherein the processor is configured to classify a frame of content that is being reproduced on the display into a plurality of blocks including at least one pixel, confirm average brightness values of each of the plurality of blocks, determine whether to satisfy at least one specified condition based on the average brightness values of the plurality of blocks, and adjust brightness of at least one pixel included in the plurality of blocks if it is determined that the at least one specified condition is satisfied.

Various embodiments of the present disclosure are directed to the provision of a method for displaying content of an electronic device, comprising: classifying a frame of content that is being reproduced on the display into a plurality of blocks including at least one pixel, confirming average brightness values of each of the plurality of blocks, determining whether to satisfy at least one specified condition based on the average brightness values of the plurality of blocks, and adjusting brightness of at least one pixel included in the plurality of blocks if it is determined that the at least one specified condition is satisfied.

According to the electronic device and the method for displaying content thereof in accordance with various embodiments of the present disclosure, it is possible to decrease the dazzling of the user while the user watches the content by adjusting the brightness of the content depending on the information of the content.

According to the electronic device and the method for displaying content thereof in accordance with various embodiments of the present disclosure, it is possible to select a part of the content based on the information of the content and adjust the brightness of a part of the selected content.

According to the electronic device and the method for displaying content thereof in accordance with various embodiments of the present disclosure, it is possible to prevent the dazzling of the user without hindering the user from watching the content by gradually changing the brightness of the content.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIGS. 6A and 6B are diagrams illustrating the operation of the electronic device according to various embodiments of the present disclosure.

DETAILED DESCRIPTION

Figure 1:
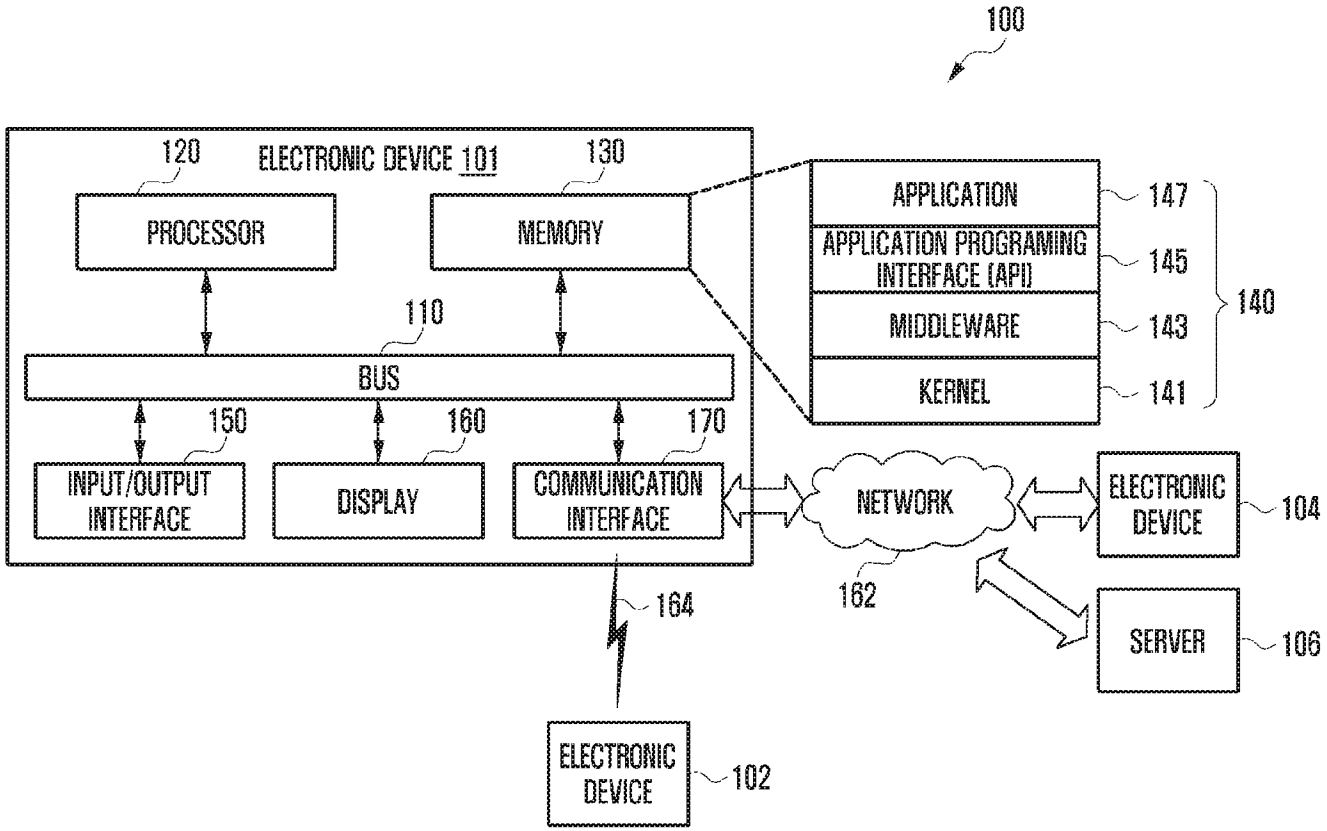
FIG. 1 is a diagram illustrating an electronic device within network environment according to various embodiments of the present disclosure.

FIGS. 1 through 14, discussed in detail below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device.

Hereinafter, various embodiments of the present disclosure are described in detail with reference to the accompanying drawings. While the present disclosure may be embodied in many different forms, specific embodiments of the present disclosure are shown in drawings and are described herein in detail, with the understanding that the drawings are to be considered as examples of the principles of the disclosure. However, the embodiments illustrated herein are not intended to limit the invention, nor are they intended to be all encompassing, as various other embodiments may be apparent to those of ordinary skill in the art. The same reference numbers are used throughout the drawings to refer to the same or like parts.

An expression "comprising" or "may comprise" used in the present disclosure indicates presence of a corresponding function, operation, or element and does not limit additional at least one function, operation, or element. Further, in the present disclosure, a term "comprise" or "have" indicates presence of a characteristic, numeral, step, operation, element, component, or combination thereof described in a specification and does not exclude presence or addition of at least one other characteristic, numeral, step, operation, element, component, or combination thereof.

In the present disclosure, an expression "or" includes any combination or the entire combination of together listed words. For example, "A or B" may include A, B, or A and B.

An expression of a first and a second in the present disclosure may represent various elements of the present disclosure, but do not limit corresponding elements. For example, the expression does not limit order and/or importance of corresponding elements. The expression may be used for distinguishing one element from another element. For example, both a first user device and a second user device are user devices and represent different user devices. For example, a first constituent element may be referred to as a second constituent element without deviating from the scope of the present disclosure, and similarly, a second constituent element may be referred to as a first constituent element.

When it is described that an element is "coupled" to another element, the element may be "directly coupled" to the other element or "electrically coupled" to the other element through a third element. However, when it is described that an element is "directly coupled" to another element, no element may exist between the element and the other element.

Terms used in the present disclosure are not to limit the present disclosure but to illustrate exemplary embodiments. When using in a description of the present disclosure and the appended claims, a singular form includes a plurality of forms unless it is explicitly differently represented.

Unless differently defined, entire terms including a technical term and a scientific term used here have the same meaning as a meaning that may be generally understood by a person of common skill in the art. It should be analyzed that generally using terms defined in a dictionary have a meaning corresponding to that of a context of related technology and are not analyzed as an ideal or excessively formal meaning unless explicitly defined.

In this disclosure, an electronic device may be a device that involves a communication function. For example, an electronic device may be a smart phone, a tablet PC (Personal Computer), a mobile phone, a video phone, an e-book reader, a desktop PC, a laptop PC, a netbook computer, a PDA (Personal Digital Assistant), a PMP (Portable Multimedia Player), an MP3 player, a portable medical device, a digital camera, or a wearable device (e.g., an HMD (Head-Mounted Device) such as electronic glasses, electronic clothes, an electronic bracelet, an electronic necklace, an electronic accessory, or a smart watch).

According to some embodiments, an electronic device may be a smart home appliance that involves a communication function. For example, an electronic device may be a TV, a DVD (Digital Video Disk) player, audio equipment, a refrigerator, an air conditioner, a vacuum cleaner, an oven, a microwave, a washing machine, an air cleaner, a set-top box, a TV box (e.g., Samsung HomeSync®, Apple TV®, Google TV®, etc.), a game console, an electronic dictionary, an electronic key, a camcorder, or an electronic picture frame.

According to some embodiments, an electronic device may be a medical device (e.g., MRA (Magnetic Resonance Angiography), MRI (Magnetic Resonance Imaging), CT (Computed Tomography), ultrasonography, etc.), a navigation device, a GPS (Global Positioning System) receiver, an EDR (Event Data Recorder), an FDR (Flight Data Recorder), a car infotainment device, electronic equipment for ship (e.g., a marine navigation system, a gyrocompass, etc.), avionics, security equipment, or an industrial or home robot.

According to some embodiments, an electronic device may be furniture or part of a building or construction having a communication function, an electronic board, an electronic signature receiving device, a projector, or various measuring instruments (e.g., a water meter, an electric meter, a gas meter, a wave meter, etc.). An electronic device disclosed herein may be one of the above-mentioned devices or any combination thereof. As well understood by those skilled in the art, the above-mentioned electronic devices are exemplary only and not to be considered as a limitation of this disclosure.

FIG. 1 is a block diagram 100 illustrating an electronic apparatus according to an embodiment of the present disclosure.

Referring to FIG. 1, the electronic apparatus 101 may include a bus 110, a processor 120, a memory 130, a user input module 150, a display 160, and a communication interface 170.

The bus 110 may be a circuit for interconnecting elements described above and for allowing a communication, e.g. by transferring a control message, between the elements described above.

The processor 120 can receive commands from the above-mentioned other elements, e.g. the memory 130, the user input module 150, the display 160, and the communication interface 170, through, for example, the bus 110, can decipher the received commands, and perform operations and/or data processing according to the deciphered commands.

The memory 130 can store commands received from the processor 120 and/or other elements, e.g. the user input module 150, the display 160, and the communication interface 170, and/or commands and/or data generated by the processor 120 and/or other elements. The memory 130 may include software and/or programs 140, such as a kernel 141, middleware 143, an Application Programming Interface (API) 145, and an application 147. Each of the programming modules described above may be configured by software, firmware, hardware, and/or combinations of two or more thereof.

The kernel 141 can control and/or manage system resources, e.g. the bus 110, the processor 120 or the memory 130, used for execution of operations and/or functions implemented in other programming modules, such as the middleware 143, the API 145, and/or the application 147. Further, the kernel 141 can provide an interface through which the middleware 143, the API 145, and/or the application 147 can access and then control and/or manage an individual element of the electronic apparatus 101.

The middleware 143 can perform a relay function which allows the API 145 and/or the application 147 to communicate with and exchange data with the kernel 141. Further, in relation to operation requests received from at least one of an application 147, the middleware 143 can perform load balancing in relation to the operation requests by, for example, giving a priority in using a system resource, e.g. the bus 110, the processor 120, and/or the memory 130, of the electronic apparatus 101 to at least one application from among the at least one of the application 147.

The API 145 is an interface through which the application 147 can control a function provided by the kernel 141 and/or the middleware 143, and may include, for example, at least one interface or function for file control, window control, image processing, and/or character control.

The user input module 150 can receive, for example, a command and/or data from a user, and transfer the received command and/or data to the processor 120 and/or the memory 130 through the bus 110. The display 160 can display an image, a video, and/or data to a user.

The communication interface 170 can establish a communication between the electronic apparatus 101 and another electronic devices 102 and 104 and/or a server 106. The communication interface 170 can support short range communication protocols, e.g. a Wireless Fidelity (WiFi) protocol, a BlueTooth® (BT) protocol, and a Near Field Communication (NFC) protocol, communication networks, e.g. Internet, Local Area Network (LAN), Wire Area Network (WAN), a telecommunication network, a cellular network, and a satellite network, or a Plain Old Telephone Service (POTS), or any other similar and/or suitable communication networks, such as network 162, or the like. Each of the electronic devices 102 and 104 may be a same type and/or different types of electronic apparatus.

Figure 2:
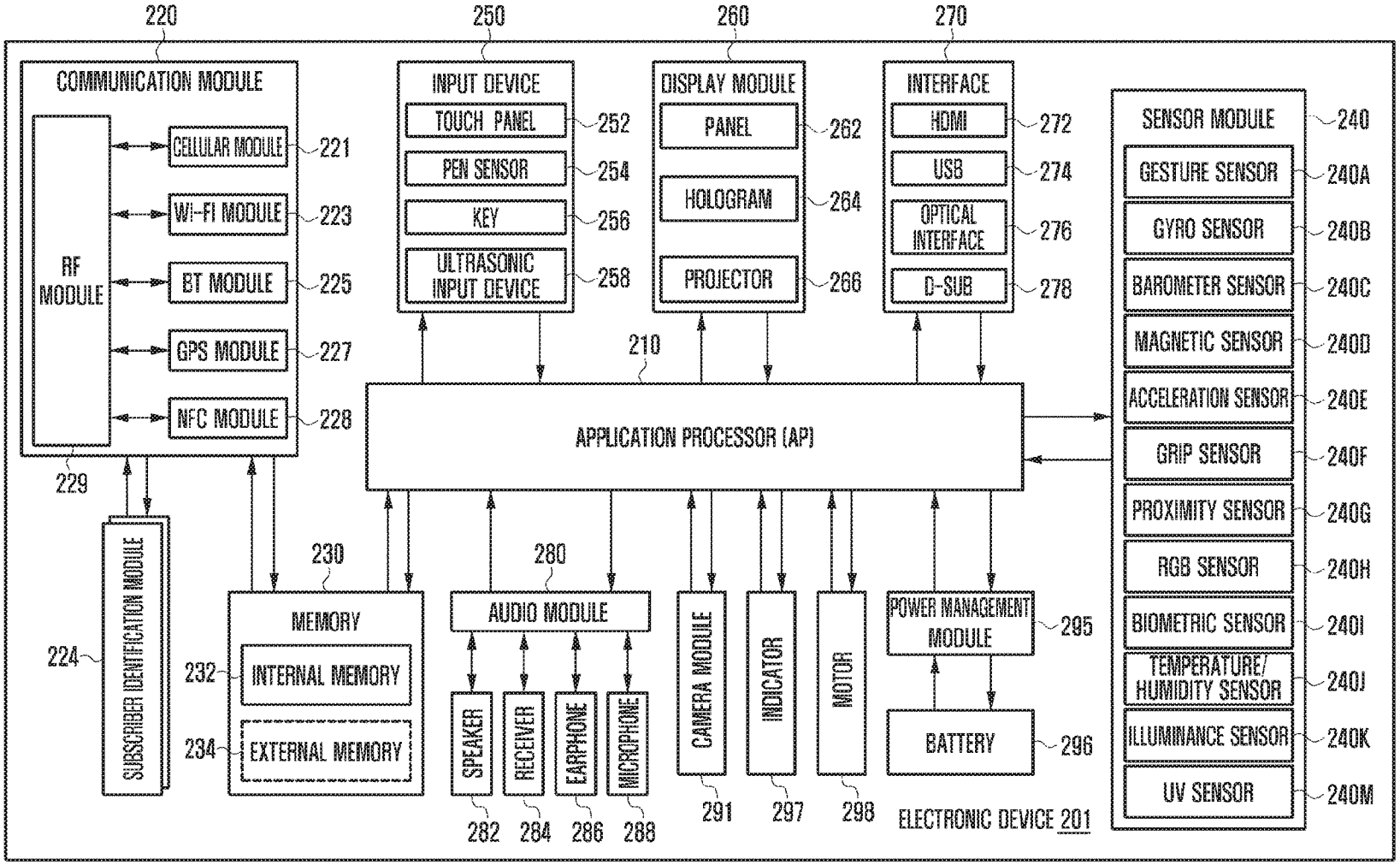
FIG. 2 is a block diagram illustrating an electronic device according to various embodiments of the present disclosure.

FIG. 2 is a block diagram illustrating an electronic device 201 in accordance with an embodiment of the present disclosure. The electronic device 201 may form, for example, the whole or part of the electronic device 101 shown in FIG. 1. Referring to FIG. 2, the electronic device 201 may include at least one application processor (AP) 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, and a motor 298.

The AP 210 may drive an operating system or applications, control a plurality of hardware or software components connected thereto, and also perform processing and operation for various data including multimedia data. The AP 210 may be formed of system-on-chip (SoC), for example. According to an embodiment, the AP 210 may further include a graphic processing unit (GPU) (not shown).

The communication module 220 (e.g., the communication interface 170) may perform a data communication with any other electronic device (e.g., the electronic device 104 or the server 106) connected to the electronic device 200 (e.g., the electronic device 101) through the network. According to an embodiment, the communication module 220 may include therein a cellular module 221, a WiFi module 323, a BT module 225, a GPS module 227, an NFC module 228, and an RF (Radio Frequency) module 229.

The cellular module 221 may offer a voice call, a video call, a message service, an internet service, or the like through a communication network (e.g., LTE, LTE-A, CDMA, WCDMA, UMTS, WiBro, or GSM, etc.). Additionally, the cellular module 221 may perform identification and authentication of the electronic device in the communication network, using the SIM card 224. According to an embodiment, the cellular module 221 may perform at least part of functions the AP 210 can provide. For example, the cellular module 221 may perform at least part of a multimedia control function.

According to an embodiment, the cellular module 221 may include a communication processor (CP). Additionally, the cellular module 221 may be formed of SoC, for example. Although some elements such as the cellular module 221 (e.g., the CP), the memory 230, or the power management module 295 are shown as separate elements being different from the AP 210 in FIG. 3, the AP 210 may be formed to have at least part (e.g., the cellular module 321) of the above elements in an embodiment.

According to an embodiment, the AP 210 or the cellular module 221 (e.g., the CP) may load commands or data, received from a nonvolatile memory connected thereto or from at least one of the other elements, into a volatile memory to process them. Additionally, the AP 210 or the cellular module 221 may store data, received from or created at one or more of the other elements, in the nonvolatile memory.

Each of the WiFi module 223, the BT module 225, the GPS module 227 and the NFC module 228 may include a processor for processing data transmitted or received there-through. Although FIG. 2 shows the cellular module 221, the WiFi module 223, the BT module 225, the GPS module 227 and the NFC module 228 as different blocks, at least part of them may be contained in a single IC (Integrated Circuit) chip or a single IC package in an embodiment. For example, at least part (e.g., the CP corresponding to the cellular module 221 and a WiFi processor corresponding to the WiFi module 223) of respective processors corresponding to the cellular module 221, the WiFi module 223, the BT module 225, the GPS module 227 and the NFC module 228 may be formed as a single SoC.

Figure 3:
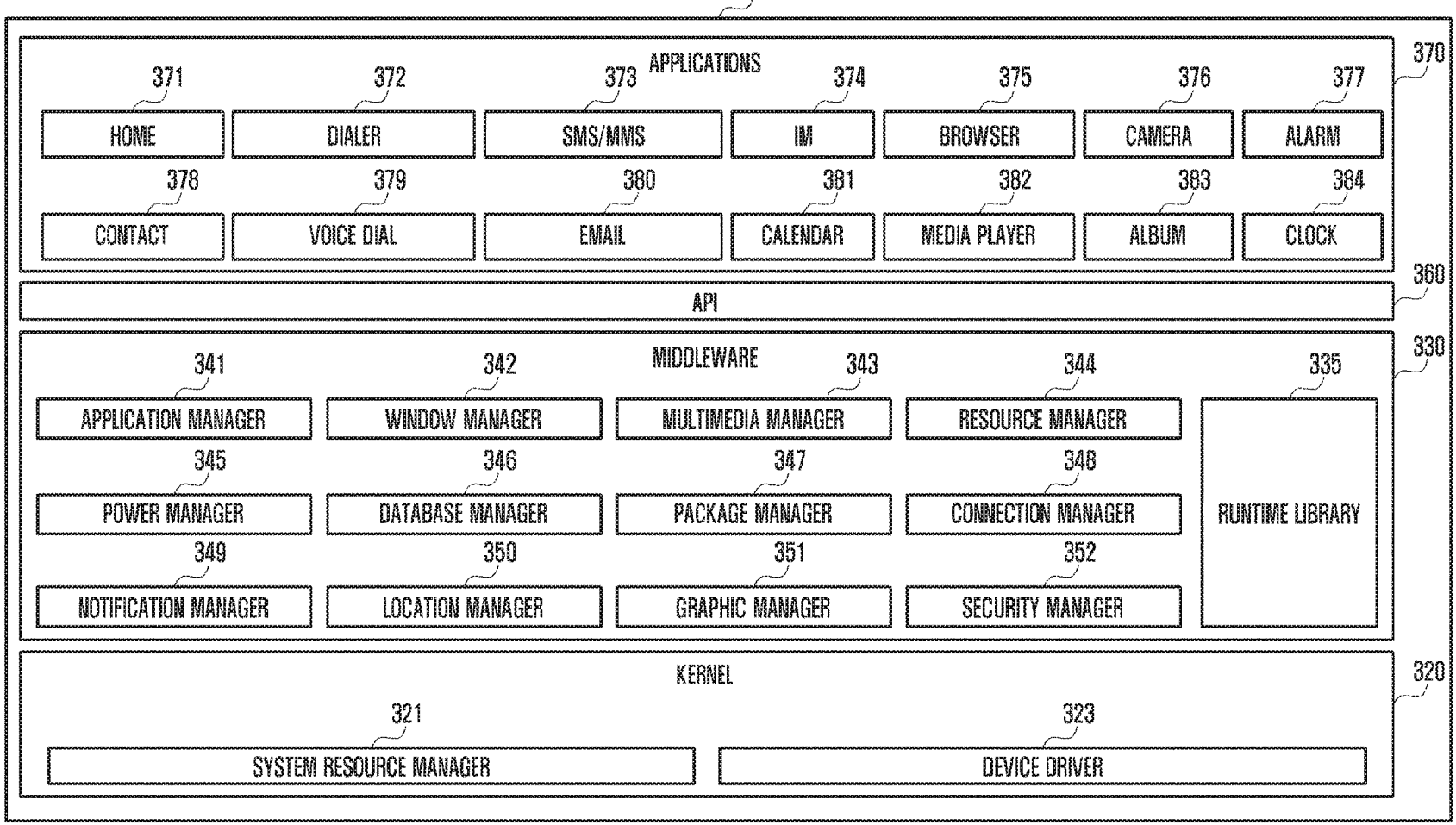
FIG. 3 is a block diagram of a program module illustrating various embodiments of the present disclosure.

The RF module 229 may transmit and receive data, e.g., RF signals or any other electric signals. Although not shown, the RF module 229 may include a transceiver, a PAM (Power Amp Module), a frequency filter, an LNA (Low Noise Amplifier), or the like. Also, the RF module 229 may include any component, e.g., a wire or a conductor, for transmission of electromagnetic waves in a free air space. Although FIG. 3 shows that the cellular module 221, the WiFi module 223, the BT module 225, the GPS module 227 and the NFC module 228 share the RF module 229, at least one of them may perform transmission and reception of RF signals through a separate RF module in an embodiment.

The SIM card 224 may be a specific card formed of SIM and may be inserted into a slot formed at a certain place of the electronic device 201. The SIM card 224 may contain therein an ICCID (Integrated Circuit Card IDentifier) or an IMSI (International Mobile Subscriber Identity).

The memory 230 (e.g., the memory 130) may include an internal memory 232 and an external memory 234. The internal memory 232 may include, for example, at least one of a volatile memory (e.g., DRAM (Dynamic RAM), SRAM (Static RAM), SDRAM (Synchronous DRAM), etc.) or a nonvolatile memory (e.g., OTPROM (One Time Programmable ROM), PROM (Programmable ROM), EPROM (Erasable and Programmable ROM), EEPROM (Electrically Erasable and Programmable ROM), mask ROM, flash ROM, NAND flash memory, NOR flash memory, etc.). According to an embodiment, the internal memory 232 may have the form of an SSD (Solid State Drive). The external memory 234 may include a flash drive, e.g., CF (Compact Flash), SD (Secure Digital), Micro-SD (Micro Secure Digital), Mini-SD (Mini Secure Digital), XD (eXtreme Digital), memory stick, or the like. The external memory 334 may be functionally connected to the electronic device 201 through various interfaces. According to an embodiment, the electronic device 301 may further include a storage device or medium such as a hard drive.

The sensor module 240 may measure physical quantity or sense an operating status of the electronic device 201, and then convert measured or sensed information into electric signals. The sensor module 240 may include, for example, at least one of a gesture sensor 240A, a gyro sensor 240B, an atmospheric sensor 240C, a magnetic sensor 240D, an acceleration sensor 240E, a grip sensor 240F, a proximity sensor 240G, a color sensor 240H (e.g., RGB (Red, Green, Blue) sensor), a biometric sensor 240I, a temperature-humidity sensor 240J, an illumination sensor 240K, and a UV (ultraviolet) sensor 240M. Additionally or alternatively, the sensor module 240 may include, e.g., an E-nose sensor (not shown), an EMG (electromyography) sensor (not shown), an EEG (electroencephalogram) sensor (not shown), an ECG (electrocardiogram) sensor (not shown), an IR (infrared) sensor (not shown), an iris scan sensor (not shown), or a finger scan sensor (not shown). Also, the sensor module 240 may include a control circuit for controlling one or more sensors equipped therein.

The input device 250 may include a touch panel 252, a digital pen sensor 254, a key 256, or an ultrasonic input unit 258. The touch panel 252 may recognize a touch input in a manner of capacitive type, resistive type, infrared type, or ultrasonic type. Also, the touch panel 252 may further include a control circuit. In case of a capacitive type, a physical contact or proximity may be recognized. The touch panel 252 may further include a tactile layer. In this case, the touch panel 252 may offer a tactile feedback to a user.

The digital pen sensor 254 may be formed in the same or similar manner as receiving a touch input or by using a separate recognition sheet. The key 256 may include, for example, a physical button, an optical key, or a keypad. The ultrasonic input unit 258 is a specific device capable of identifying data by sensing sound waves with a microphone 288 in the electronic device 201 through an input tool that generates ultrasonic signals, thus allowing wireless recognition. According to an embodiment, the electronic device 201 may receive a user input from any external device (e.g., a computer or a server) connected thereto through the communication module 220.

The display 260 (e.g., the display 250) may include a panel 262, a hologram 264, or a projector 266. The panel 262 may be, for example, LCD (Liquid Crystal Display), AM-OLED (Active Matrix Organic Light Emitting Diode), or the like. The panel 262 may have a flexible, transparent or wearable form. The panel 262 may be formed of a single module with the touch panel 252. The hologram 264 may show a stereoscopic image in the air using interference of light. The projector 266 may project an image onto a screen, which may be located at the inside or outside of the electronic device 201. According to an embodiment, the display 260 may further include a control circuit for controlling the panel 262, the hologram 264, and the projector 266.

The interface 270 may include, for example, an HDMI (High-Definition Multimedia Interface) 272, a USB (Universal Serial Bus) 274, an optical interface 276, or a D-sub (D-subminiature) 278. The interface 270 may be contained, for example, in the communication interface 160 shown in FIG. 1. Additionally or alternatively, the interface 270 may include, for example, an MHL (Mobile High-definition Link) interface, an SD (Secure Digital) card/MMC (Multi-Media Card) interface, or an IrDA (Infrared Data Association) interface.

The audio module 280 may perform a conversion between sounds and electric signals. The audio module 280 may process sound information inputted or outputted through a speaker 282, a receiver 284, an earphone 286, or a microphone 288.

The camera module 291 is a device capable of obtaining still images and moving images. According to an embodiment, the camera module 291 may include at least one image sensor (e.g., a front sensor or a rear sensor), a lens (not shown), an ISP (Image Signal Processor, not shown), or a flash (e.g., LED or xenon lamp, not shown).

The power management module 295 may manage electric power of the electronic device 201. Although not shown, the power management module 295 may include, for example, a PMIC (Power Management Integrated Circuit), a charger IC, or a battery or fuel gauge.

The PMIC may be formed, for example, of an IC chip or SoC. Charging may be performed in a wired or wireless manner. The charger IC may charge a battery 296 and prevent overvoltage or overcurrent from a charger. According to an embodiment, the charger IC may have a charger IC used for at least one of wired and wireless charging types. A wireless charging type may include, for example, a magnetic resonance type, a magnetic induction type, or an electromagnetic type. Any additional circuit for a wireless charging may be further used such as a coil loop, a resonance circuit, or a rectifier.

The battery gauge may measure the residual amount of the battery 296 and a voltage, current or temperature in a charging process. The battery 296 may store or create electric power therein and supply electric power to the electronic device 201. The battery 296 may be, for example, a rechargeable battery or a solar battery.

The indicator 297 may show thereon a current status (e.g., a booting status, a message status, or a recharging status) of the electronic device 201 or of its part (e.g., the AP 210). The motor 298 may convert an electric signal into a mechanical vibration. Although not shown, the electronic device 301 may include a specific processor (e.g., GPU) for supporting a mobile TV. This processor may process media data that comply with standards of DMB (Digital Multimedia Broadcasting), DVB (Digital Video Broadcasting), or media flow.

Each of the above-discussed elements of the electronic device disclosed herein may be formed of one or more components, and its name may be varied according to the type of the electronic device. The electronic device disclosed herein may be formed of at least one of the above-discussed elements without some elements or with additional other elements. Some of the elements may be integrated into a single entity that still performs the same functions as those of such elements before integrated.

The term "module" used in this disclosure may refer to a certain unit that includes one of hardware, software and firmware or any combination thereof. The module may be interchangeably used with unit, logic, logical block, component, or circuit, for example. The module may be the minimum unit, or part thereof, which performs one or more particular functions. The module may be formed mechanically or electronically. For example, the module disclosed herein may include at least one of ASIC (Application-Specific Integrated Circuit) chip, FPGAs (Field-Programmable Gate Arrays), and programmable-logic device, which have been known or are to be developed.

FIG. 3 is a block diagram illustrating a configuration of a programming module 310 according to an embodiment of the present disclosure.

The programming module 310 may be included (or stored) in the electronic device 301 (e.g., the memory 330) illustrated in FIG. 1 or may be included (or stored) in the electronic device 201 (e.g., the memory 230) illustrated in FIG. 2. At least a part of the programming module 310 may be implemented in software, firmware, hardware, or a combination of two or more thereof. The programming module 310 may be implemented in hardware, and may include an OS controlling resources related to an electronic device (e.g., the electronic device 101 or 201) and/or various applications (e.g., an application 370) executed in the OS. For example, the OS may be Android®, iOS®, Windows®, Symbian®, Tizen®, Bada®, and the like.

Referring to FIG. 3, the programming module 310 may include a kernel 320, a middleware 330, an API 360, and/or the application 370.

The kernel 320 (e.g., the kernel 211) may include a system resource manager 321 and/or a device driver 323. The system resource manager 321 may include, for example, a process manager (not illustrated), a memory manager (not illustrated), and a file system manager (not illustrated). The system resource manager 321 may perform the control, allocation, recovery, and/or the like of system resources. The device driver 323 may include, for example, a display driver (not illustrated), a camera driver (not illustrated), a Bluetooth driver (not illustrated), a shared memory driver (not illustrated), a USB driver (not illustrated), a keypad driver (not illustrated), a Wi-Fi driver (not illustrated), and/or an audio driver (not illustrated). Also, according to an embodiment of the present disclosure, the device driver 323 may include an Inter-Process Communication (IPC) driver (not illustrated).

The middleware 330 may include multiple modules previously implemented so as to provide a function used in common by the applications 370. Also, the middleware 330 may provide a function to the applications 370 through the API 360 in order to enable the applications 370 to efficiently use limited system resources within the electronic device. For example, as illustrated in FIG. 3, the middleware 330 (e.g., the middleware 143) may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, a security manager 352, and any other suitable and/or similar manager.

The runtime library 335 may include, for example, a library module used by a complier, in order to add a new function by using a programming language during the execution of the application 370. According to an embodiment of the present disclosure, the runtime library 435 may perform functions which are related to input and output, the management of a memory, an arithmetic function, and/or the like.

The application manager 341 may manage, for example, a life cycle of at least one of the applications 370. The window manager 342 may manage GUI resources used on the screen. The multimedia manager 343 may detect a format used to reproduce various media files and may encode or decode a media file through a codec appropriate for the relevant format. The resource manager 344 may manage resources, such as a source code, a memory, a storage space, and/or the like of at least one of the applications 370.

The power manager 345 may operate together with a Basic Input/Output System (BIOS), may manage a battery or power, and may provide power information and the like used for an operation. The database manager 346 may manage a database in such a manner as to enable the generation, search and/or change of the database to be used by at least one of the applications 370. The package manager 347 may manage the installation and/or update of an application distributed in the form of a package file.

The connectivity manager 348 may manage a wireless connectivity such as, for example, Wi-Fi and Bluetooth. The notification manager 349 may display or report, to the user, an event such as an arrival message, an appointment, a proximity alarm, and the like in such a manner as not to disturb the user. The location manager 350 may manage location information of the electronic device. The graphic manager 351 may manage a graphic effect, which is to be provided to the user, and/or a user interface related to the graphic effect. The security manager 352 may provide various security functions used for system security, user authentication, and the like. According to an embodiment of the present disclosure, when the electronic device (e.g., the electronic device 101) has a telephone function, the middleware 330 may further include a telephony manager (not illustrated) for managing a voice telephony call function and/or a video telephony call function of the electronic device.

The middleware 330 may generate and use a new middleware module through various functional combinations of the above-described internal element modules. The middleware 330 may provide modules specialized according to types of OSs in order to provide differentiated functions. Also, the middleware 330 may dynamically delete some of the existing elements, or may add new elements. Accordingly, the middleware 330 may omit some of the elements described in the various embodiments of the present disclosure, may further include other elements, or may replace the some of the elements with elements, each of which performs a similar function and has a different name.

The API 460 (e.g., the API 145) is a set of API programming functions, and may be provided with a different configuration according to an OS. In the case of Android or iOS, for example, one API set may be provided to each platform. In the case of Tizen, for example, two or more API sets may be provided to each platform.

The applications 370 (e.g., the applications 147) may include, for example, a preloaded application and/or a third party application. The applications 370 (e.g., the applications 147) may include, for example, a home application 371, a dialer application 372, a Short Message Service (SMS)/Multimedia Message Service (MMS) application 373, an Instant Message (IM) application 374, a browser application 375, a camera application 376, an alarm application 377, a contact application 378, a voice dial application 379, an electronic mail (e-mail) application 380, a calendar application 381, a media player application 382, an album application 383, a clock application 384, and any other suitable and/or similar application.

At least a part of the programming module 310 may be implemented by instructions stored in a non-transitory computer-readable storage medium. When the instructions are executed by one or more processors (e.g., the application processor 210), the one or more processors may perform functions corresponding to the instructions. The non-transitory computer-readable storage medium may be, for example, the memory 220. At least a part of the programming module 310 may be implemented (e.g., executed) by, for example, the one or more processors. At least a part of the programming module 310 may include, for example, a module, a program, a routine, a set of instructions, and/or a process for performing one or more functions.

An electronic device according to various embodiments of the present disclosure may include a display and a processor electrically connected to the display. According to one embodiment of the present disclosure, the processor may be configured to classify a frame of content that is being reproduced on the display into a plurality of blocks including at least one pixel, confirm average brightness values of each of the plurality of blocks, determine whether to satisfy at least one specified condition based on the average brightness values of the plurality of blocks, and adjust brightness of at least one pixel included in the plurality of blocks if it is determined that the at least one specified condition is satisfied.

According to one embodiment of the present disclosure, the processor may be configured to measure illumination around the electronic device and adjust brightness of the at least one pixel when the measured illumination is equal to or less than a specified reference illumination value.

According to one embodiment of the present disclosure, the processor may be configured to adjust the brightness of the at least one pixel when an average brightness value of at least one of the plurality of blocks is equal to or more than a specified first reference brightness value.

According to one embodiment of the present disclosure, the processor may be configured to adjust the brightness of the at least one pixel when a total of average brightness values of all of the plurality of blocks is equal to or more than a specified second reference brightness value.

According to one embodiment of the present disclosure, the processor may be configured to confirm a size of an area formed by contacting at least one block having the largest average brightness value to each other among the plurality of blocks and adjust the brightness of the at least one pixel when the size of the formed area is equal to or more than that of a specified reference area.

According to one embodiment of the present disclosure, the processor may be configured to calculate deviations in average brightness values of adjacent blocks of each of the plurality of blocks and adjust the brightness of the at least one pixel when the largest value among the deviations in the average brightness values of each of the plurality of blocks is equal to or more than a reference deviation value.

According to one embodiment of the present disclosure, the processor may be configured to recognize a pixel whose brightness value is equal to or more than a specified reference adjustment value among the at least one pixel and decrease brightness of the recognized pixel.

According to one embodiment of the present disclosure, the processor may be configured to adjust the brightness of the at least one pixel depending on a specified ratio.

According to one embodiment of the present disclosure, the processor may be configured to gradually change the brightness of the at least one pixel in a plurality of frame sections of the content.

According to one embodiment of the present disclosure, the processor may be configured to determine a ratio to decrease the brightness of the at least one pixel depending on the at least one condition.

According to various embodiments of the present disclosure, the electronic device may include a display including a display driver IC (DDI) and a panel and a processor electrically connected to the display. According to a control of the processor, the display driver IC may be configured to classify a frame of content that is being reproduced on the panel into a plurality of blocks including at least one pixel, confirm average brightness values of each of the plurality of blocks, determine whether to satisfy at least one specified condition based on at least some of the respective average brightness values, and adjust brightness of at least one pixel included in the plurality of blocks if it is determined that the at least one specified condition is satisfied.

Figure 4:
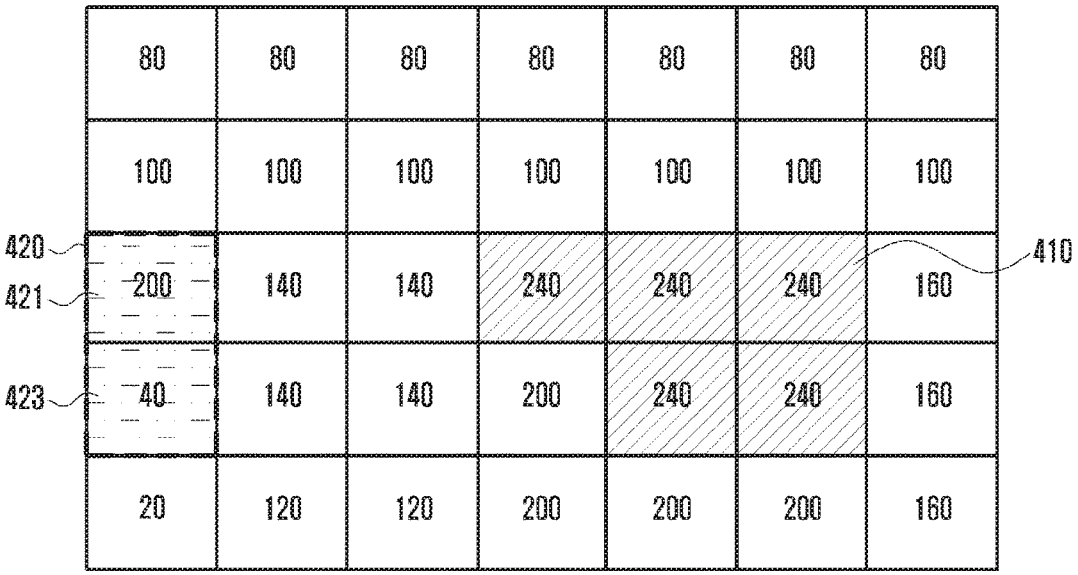
FIG. 4 is a diagram illustrating an operation of confirming brightness of a content of the electronic device according to various embodiments of the present disclosure.

FIG. 4 is a diagram for describing an operation of confirming brightness of a content of the electronic device according to various embodiments of the present disclosure.

FIG. 4 illustrates an example in which a frame of content that is being reproduced in the electronic device is classified into a plurality of blocks, in which numbers in the respective blocks represents an average brightness value of the corresponding block. Hereinafter, the above example will be described under the assumption that a range of a brightness value between 0 and 255.

The electronic device may classify (divide) the frame into the plurality of blocks. For example, the electronic device may classify a frame of content into 35 blocks as illustrate in FIG. 4. According to various embodiments of the present disclosure, the number, a size, and a shape of blocks that are classified by the electronic device may be variously changed.

Each frame may include at least one pixel. The electronic device may confirm average brightness value of each of the classified blocks. For example, the electronic device may calculate the average of the brightness values of the pixels included in the respective blocks. The electronic device may determine whether to adjust brightness of content based on the average brightness values of the respective blocks. The electronic device may determine whether to satisfy the specified condition based on the average brightness values of the respective blocks.

According to one embodiment of the present disclosure, the electronic device may determine whether the largest average brightness value among the average brightness values of the plurality of blocks is equal to or more than the specified first reference brightness value. For example, the electronic device may confirm that the largest average brightness value among the average brightness values of the respective blocks is 240. When the first reference brightness value is 210, the electronic device may determine whether the largest average brightness value is equal to or more than 210. When the largest average brightness value is equal to or more than the specified first reference brightness value, the electronic device may adjust the brightness of at least one pixel. For example, the electronic device may decrease the brightness of at least one pixel to prevent the dazzling of the user.

According to one embodiment of the present disclosure, the electronic device may determine whether the total of average brightness values of all blocks is equal to or more than the specified second reference brightness value. For example, the electronic device may confirm or calculate the total of average brightness values of the frame of content. For example, in FIG. 4, the total of average brightness values of all the blocks is 137. The electronic device may determine whether the total of average brightness values is equal to or more than the specified second reference brightness value. When the total of average brightness values is equal to or more than the specified second reference brightness value, the electronic device may adjust the brightness of at least one pixel.

According to one embodiment of the present disclosure, the electronic device may confirm the size of the area formed by contacting at least one block having the largest average brightness value to each other. For example, in FIG. 4, the largest value among the average brightness values of the respective blocks is 240 and five blocks 410 having the average brightness value of 240 are adjacent to each other. Here, the blocks adjacent to each other mean blocks whose least some surfaces directly contact each other. Referring to FIG. 4, five blocks 410 having the average brightness value of 240 are disposed in a state in which at least one surface of the five blocks 410 contact each other. In this case, the electronic device may recognize a size of an area formed by the five blocks 410. The electronic device may determine whether the area formed by the blocks 410 adjacent to each other and having the maximum average brightness value is equal to or more than that of the specified reference area. When the size of the formed area is equal to or more than that of the specified reference area, the electronic device may adjust the brightness of at least one pixel. For example, if the size of the reference area is a summed value of areas of three blocks, the electronic device may confirm that the area formed by the adjacent blocks 410 having the maximum average brightness value is an area of a total of five blocks and is equal to or more than the size of the reference area. In this case, the electronic device may decrease the brightness of at least one pixel. According to various embodiments of the present disclosure, the electronic device may perform the same operation b comparing the number of adjacent blocks 410 having the maximum average brightness value with the specified value without directly calculating the size of the area formed by the adjacent blocks 410 having the maximum average brightness value. For example, the electronic device may decrease the brightness of at least one pixel when the number of adjacent blocks 410 having the maximum average brightness value is equal to or more than the specified value. For example, referring to FIG. 4, when the specified value is four, the electronic device may confirm that the number of adjacent blocks 410 having the largest average brightness value of 240 is five in total. When the number of adjacent blocks 410 is specified four, the electronic device may adjust the brightness value of at least one pixel.

According to one embodiment of the present disclosure, the electronic device may determine whether the deviation in the average brightness value is equal to or more than the specified reference deviation value. For example, the electronic device may calculate the deviations in the average brightness values of adjacent blocks of each of the plurality of blocks. For example, in the case of a third block 421 of a first column, an average brightness value is 200. The block 421 is enclosed by five blocks around which each of the average brightness values each are from top to bottom clockwise is 100, 100, 140, 140, and 20. The electronic device may calculate deviations in average brightness values between a block of a third row of the first column and adjacent blocks therearound. In this case, the electronic device may confirm that the deviation in the average brightness value between the block 421 and a block just below the block 421 is largest as 160. The electronic device may confirm the deviation in the largest brightness value by calculating deviations in brightness values of adjacent blocks around each block by the foregoing method. For example, the electronic device may check that the block of the third row of the first column and a block 420 (421 and 423) of a fourth row among all the blocks have the deviation in the average brightness value of the largest value. The electronic device may determine whether a maximum value among the deviations in the average brightness values between blocks is equal to or more than the specified reference deviation value. The electronic device may decrease the brightness of at least one pixel when the maximum value among the deviations in the average brightness values is equal to or the reference deviation value.

According to various embodiments of the present disclosure, the electronic device may adjust at least one pixel of content when satisfying at least one of the condition that the largest average brightness value among the average brightness values of each block is equal to or more than the first reference brightness value, the condition that the total of average brightness values of all the blocks is equal to or more than the second reference brightness value, the condition that the size of the area in which the adjacent blocks having the maximum average brightness value are formed is equal to or more than the size of the reference areas, and the condition that the maximum value among the deviations in the average brightness values between blocks is equal to or more than the reference deviation value.

According to various embodiments of the present disclosure, the electronic device may differently determine how much (for example, change ratio, target value after the change, or the like) brightness is changed depending on a kind or the number of satisfying conditions among the conditions.

According to various embodiments of the present disclosure, the electronic device may variously set or change the first reference brightness value, the second reference brightness value, the size of the reference area, or the reference deviation value depending on the user input.

According to various embodiments of the present disclosure, the electronic device may determine that the dazzling occurs upon the reproduction of content when satisfying the conditions to decrease the brightness of the content, thereby decreasing a fatigue of user's eyes and increase convenience of a user which watches content.

According various embodiments of the present disclosure, the electronic device may increase or decrease the brightness of the content as needed by using the above-mentioned principle.

Figure 5:
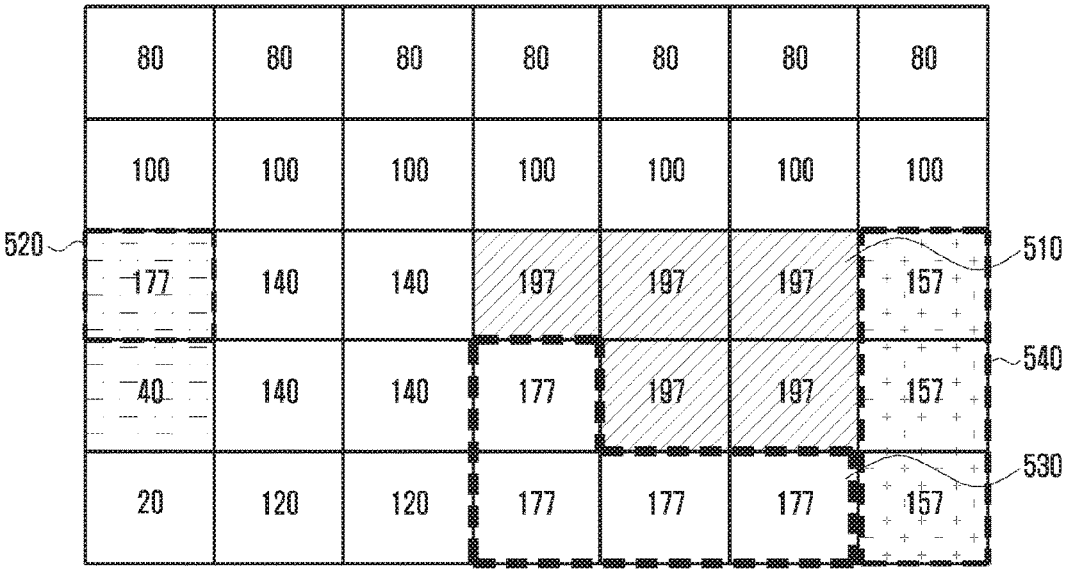
FIG. 5 is a diagram illustrating an example of a result of adjusting the brightness of the content of the electronic device according to various embodiments of the present disclosure.

FIG. 5 is a diagram illustrating an example of a result of adjusting brightness of a content of the electronic device according to various embodiments of the present disclosure. FIG. 5 illustrates average brightness values of the respective blocks after the brightness of the blocks illustrated in FIG. 4 is adjusted.

According to various embodiments of the prevent disclosure, the electronic device may adjust the brightness of at least one pixel of a frame of a content based on the average brightness values of the respective blocks, when satisfying the specified conditions. According to one embodiment of the present disclosure, the electronic device may decrease the brightness of all pixels at the specified ratio when satisfying the specified condition. For example, the electronic device may decrease brightness values distributed within a range between 0 and 255 to brightness values within a range between 0 and 205 by the fixed rate. For example, the electronic device may change a pixel having a brightness value of 225 to a brightness value of 205, a pixel having a brightness value of 240 to a brightness value of 197, and a pixel having a brightness value of 200 to a brightness value of 177.

According to one embodiment of the present disclosure, the electronic device may change the brightness values of some of the pixels depending on the specified reference. For example, the electronic device may recognize pixels of which the brightness values are equal to or more than the specified reference adjustment value to decrease the brightness of the recognized pixels.

According to one embodiment of the present disclosure, the electronic device may recognize blocks in which the average brightness values of the respective blocks are equal to or more than the reference adjustment value to decrease the brightness of the pixels included in the recognized blocks. For example, referring to FIG. 5, the electronic device illustrates the result of the case in which the brightness of the blocks in which the average brightness values of the respective blocks illustrated in FIG. 4 is equal to or more than the reference adjustment value of 150 is decreased. For example, the electronic device may keep the brightness without changing the average brightness value in the case of the blocks in which the average brightness value is less than 150. The electronic device may decrease the brightness of the block (that is, pixels included in a block) in which the average brightness value is equal to or more than 150. For example, the electronic device may adjust the brightness so that average brightness values of blocks 510 having an average brightness value of 240 become 197, average brightness values of blocks 520 and 530 having an average brightness value of 200 become 177, and average brightness values of blocks 540 having an average brightness value of 160 become 157.

According to various embodiments of the present disclosure, the electronic device may selectively adjust brightness of a high brightness part causing the dazzling of the content, thereby decreasing disharmony of a user who is watching content and preventing dazzling.

According various embodiments of the present disclosure, the electronic device may increase or decrease the brightness of the content as needed by using the above-mentioned principle.

Figure 6B:
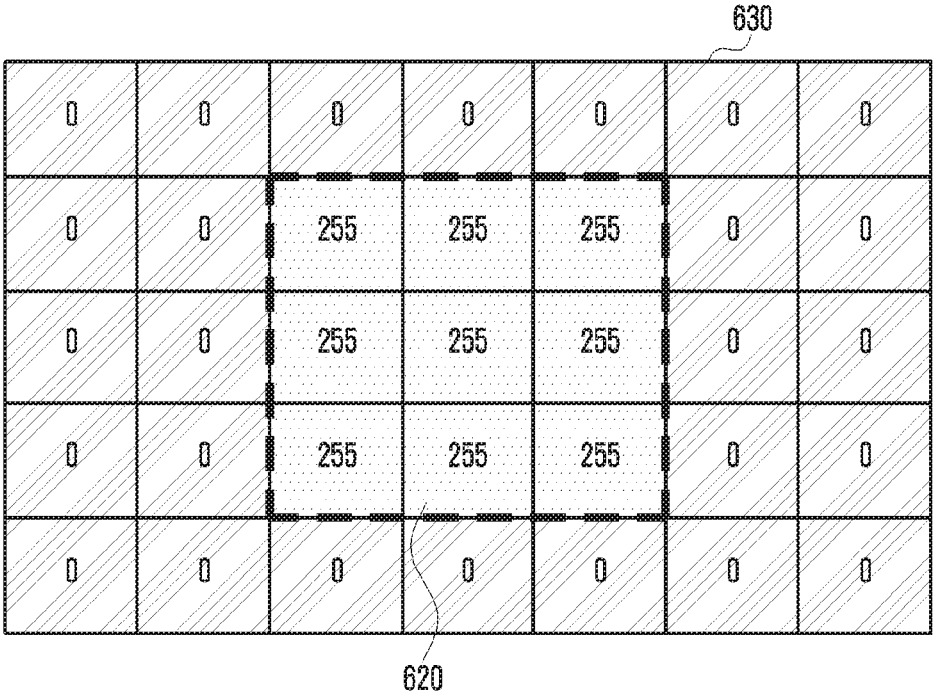

FIGS. 6A and 6B are diagrams illustrating the operation of the electronic device according to various embodiments of the present disclosure. FIGS. 6A and 6B illustrate two cases in which the total of average brightness values of all the blocks is 65. FIG. 6A illustrates the case in which average brightness values of all blocks 610 are 65. FIG. 6B illustrates a case in which average brightness values of some blocks 620 are 255 and average brightness values of the rest blocks 630 are 0.

According to various embodiments of the present disclosure, the electronic device may adjust the brightness of at least one pixel of a frame of a content based on deviations in average brightness values between blocks classifying the frame of the content which is reproducing. For example, even though the total of average brightness values is the same, in the case of FIG. 6A, there are no deviations in the brightness between the blocks, and therefore the dazzling may not be caused. On the other hand, in the case of FIG. 6B, the deviations in the brightness between the specific blocks are severe, and therefore the dazzling may occur due to the glaring.

According to various embodiments of the present disclosure, even though the blocks classifying the frame of the content have the total of average brightness values, the electronic device recognizes the case in which the deviations in the average brightness values between the respective blocks are severer as the case in which the severer dazzling occurs and may adjust the brightness of the respective blocks or the pixels included in the respective blocks.

According various embodiments of the present disclosure, the electronic device may increase or decrease the brightness of the content as needed by using the above-mentioned principle.

Figure 7:
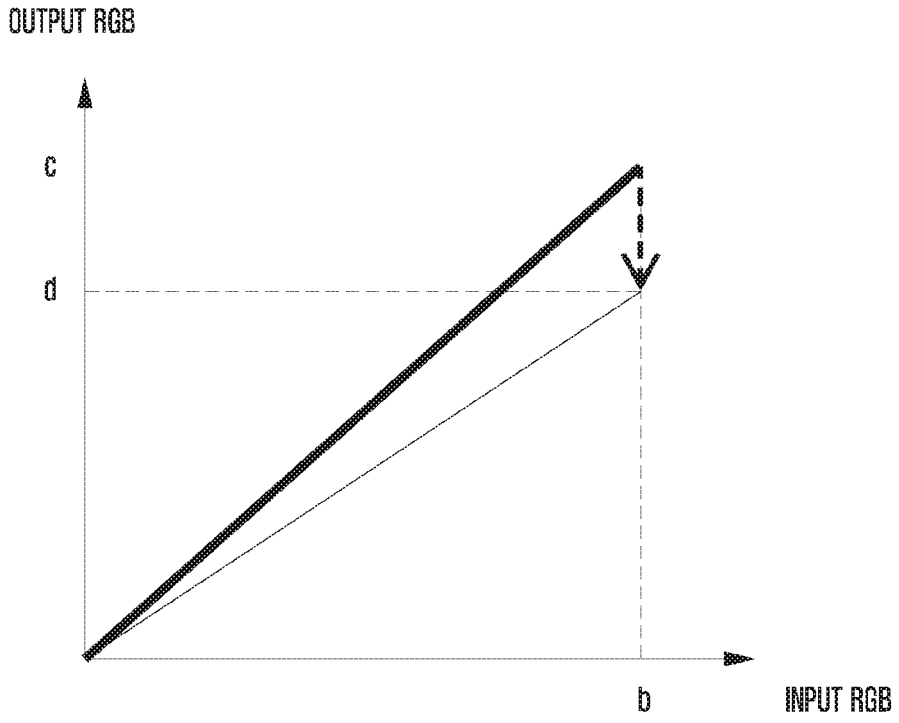
FIG. 7 is a diagram illustrating the operation of adjusting the brightness of the content of the electronic device according to various embodiments of the present disclosure.

FIG. 7 is a diagram for describing an operation of adjusting brightness of content of the electronic device according to various embodiments of the present disclosure. FIG. 7 illustrates the case in which the electronic device uniformly changes brightness of all the pixels of a frame of content.

The electronic device may adjust the brightness of at least one pixel included in the frame of the content. The electronic device may decrease the brightness of the pixel depending on the specified ratio. For example, the electronic device may decrease the range of the brightness value of the pixel. For example, the electronic device may adjust the range of the brightness value of the pixel from a range between 0 and 255 to a range between 0 and 205. Referring to FIG. 7, the electronic device may change a maximum value c (for example, 255) in a range of output brightness before being changed to a maximum value d (for example, 205) in a range of output brightness after being changed.

For example, if the electronic device outputs a signal having the same output value as the input value prior to adjusting the range of the brightness value of the pixel, the electronic device may output the signal of the output value decreasing at the specified ratio in proportion to the input value after adjusting the range of the brightness value.

According various embodiments of the present disclosure, the electronic device may increase or decrease the brightness of the content as needed by using the above-mentioned principle.

Figure 8:
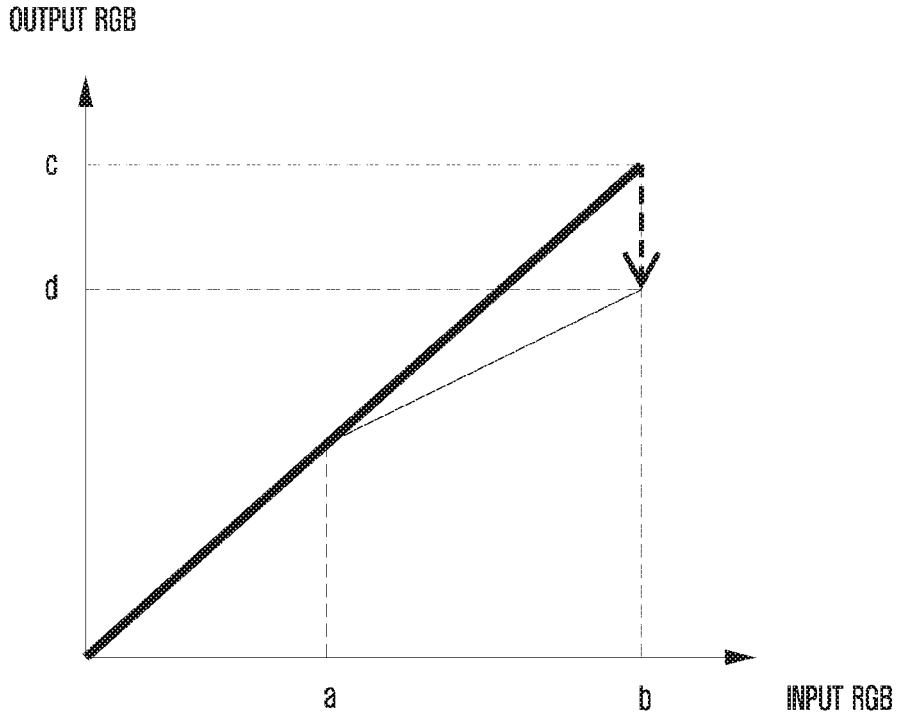
FIG. 8 is a diagram illustrating the operation of adjusting the brightness of the content of the electronic device according to various embodiments of the present disclosure.

FIG. 8 is a diagram for describing an operation of adjusting brightness of content of the electronic device according to various embodiments of the present disclosure. FIG. 8 illustrates the case in which the electronic device changes brightness of some of pixels of a frame of content.

The electronic device may adjust the brightness of at least one pixel included in the frame of the content. According to one embodiment of the present disclosure, the electronic device may decrease the brightness of some of the pixels depending on the specified ratio. For example, the electronic device may decrease a range of the brightness value of the pixel. For example, the electronic device may adjust the range of the brightness value of the pixel from the range between 0 and 255 to the range between 0 and 205. The electronic device may decrease the brightness of the pixels in which the output brightness value is equal to or more than a specified reference adjustment value a, among the pixels. Referring to FIG. 8, the electronic device may change a maximum value c (for example, 255) in the range of the output brightness before being changed to a maximum value d (for example, 205) in the range of the output brightness after being changed. For example, the electronic device may determine whether the brightness values of each pixel is equal to or more than the reference adjustment value a (for example, 150). The electronic device may decrease at the specified rate the output brightness values of the pixels in which the output brightness value is equal to or more than the reference adjustment value a.

According various embodiments of the present disclosure, the range of the input and output brightness values and the reference adjustment value a may be variously changed, and the electronic device may variously set or change the range of the input and output brightness values and the reference adjustment value a depending on the input of the user.

According to various embodiments of the present disclosure, the electronic device may adjust the value of the output signal to the input signal of the pixel, thereby adjusting the brightness of the pixel. For example, the electronic device may change RGB values of the pixel to adjust the brightness of the pixel.

According various embodiments of the present disclosure, the electronic device may increase or decrease the brightness of the content as needed by using the above-mentioned principle.

Figure 9:
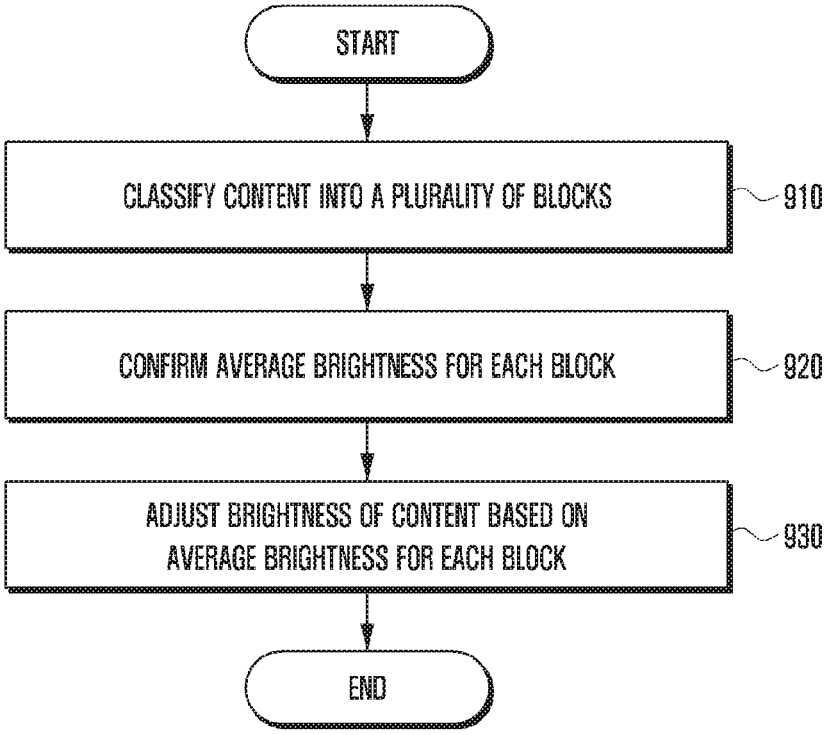
FIG. 9 is a flow chart illustrating a method for displaying content of an electronic device according to various embodiments of the present disclosure.

FIG. 9 is a flow chart of a method for displaying content of an electronic device according to various embodiments of the present disclosure.

In operation 910, the electronic device (for example, processor or display driver IC (DDI)) may classify content into a plurality of blocks. For example, the electronic device (for example, processor or DDI) may classify the frame into the plurality of blocks including at least one pixel, every frame during the reproduction of content. According to various embodiments of the present disclosure, the number, size, and shape of blocks may be variously changed and may be selected depending on the input of the user.

According to one embodiment of the present disclosure, the electronic device (for example, processor or DDI) may measure illumination around the electronic device prior to classifying content. For example, the electronic device (for example, processor or DDI) may measure the illumination around the electronic device using an illumination sensor, or the like. The electronic device may classify content into blocks when the measured illumination is equal to or less than specified illumination. For example, dazzling does not occur under the environment that the surrounding illumination is high, and therefore there may be the case in which the brightness of the content need not be changed. According to one embodiment of the present disclosure, the electronic (for example, processor or DDI) may adjust the brightness of the content to prevent dazzling from occurring only at low illumination environment.

In operation 920, the electronic device (for example, processor or DDI) may confirm the average brightness for each block. For example, the electronic device may confirm the brightness of at least one pixel included in each block every frame of content and calculate the average brightness values of each block.

In operation 930, the electronic device (for example, processor or DDI) may adjust brightness of content based on the average brightness for each block.

According to one embodiment of the present disclosure, the electronic device (for example, processor or DDI) may determine whether to adjust the brightness of the content based on the average brightness for each block. For example, the electronic device may adjust the brightness of the content when satisfying the at least one specified condition based on the average brightness values of each block. According to various embodiments of the present disclosure, at least one condition may include the condition that the largest average brightness value among the average brightness values of each block is equal to or more than the first reference brightness value, the condition that the total of average brightness values of all the blocks is equal to or more than the second reference brightness value, the condition that the size of the area in which the adjacent blocks having the maximum average brightness value are formed is equal to or more than the size of the reference areas, and the condition that the maximum value among the deviations in the average brightness values between blocks is equal to or more than the reference deviation value.

According to one embodiment of the present disclosure, the electronic device (for example, processor or DDI) may adjust brightness of at least one pixel of content when the largest maximum average brightness value among the average brightness values of the plurality of blocks is equal to or more than the specified first reference brightness value.

According to one embodiment of the present disclosure, the electronic device (for example, processor or DDI) may adjust brightness of at least one pixel of content when the total of average brightness values of all the blocks is equal to or more than the specified second reference brightness value.

According to one embodiment of the present disclosure, the electronic device (for example, processor or DDI) may confirm the size of the area formed by contacting at least one block having the largest average brightness value to each other. The electronic device may determine whether the area formed by the blocks having the maximum average brightness value and adjacent to each other is equal to or more than that of the specified reference area. When the size of the formed area is equal to or more than that of the specified reference area, the electronic device (for example, processor or DDI) may adjust the brightness of at least one pixel.

According to one embodiment of the present disclosure, the electronic device (for example, processor or DDI) may determine whether the deviation in the average brightness value is equal to or more than the specified reference deviation value. For example, the electronic device may calculate the deviations in the average brightness values of adjacent blocks of each of the plurality of blocks. The electronic device may confirm the deviation in the largest brightness value by calculating deviations in brightness values of adjacent blocks around each block by the foregoing method. The electronic device may determine whether a maximum value among the deviations in the average brightness values between blocks is equal to or more than the specified reference deviation value. The electronic device may adjust the brightness of at least one pixel when the maximum value among the deviations in the average brightness values is equal to or the reference deviation value.

According to one embodiment of the present disclosure, the electronic device (for example, processor or DDI) may adjust brightness of at least one pixel of a frame of the content. For example, the electronic device may decrease the brightness of all pixels of the frame of the content depending on the specified ratio. For example, the electronic device (for example, processor or DDI) may change the range of the brightness values of the pixels. For example, the electronic device may change a range of brightness value from 0 to 255 that may be included in the pixels to a range between 0 and 200, or the like.

According to one embodiment of the present disclosure, the electronic device (for example, processor or DDI) may determine the ratio of decreasing the brightness depending on at least one condition for adjusting the brightness. For example, the electronic device (for example, processor or DDI) may determine the range of the brightness value after being changed depending on at least one condition for adjusting the brightness. For example, when the range of the brightness value is 0 to 255, the electronic device may decrease the maximum value in the range of the brightness value by 20 when the maximum average brightness value is equal to or more than the first reference brightness value and decrease the maximum value in the range of the brightness value when the total of average brightness values is equal to or more than the second reference brightness value. The electronic device may decrease the maximum value in the range of the brightness value by 10 when the size of the area in which the blocks adjacent to each other are formed is equal to or more than the size of the reference area and decrease the maximum value in the range of the brightness value when the maximum value of the deviation in the average brightness value is equal to or more than the reference deviation value. For example, when satisfying all the conditions, the electronic device may decrease the maximum value in the range of the brightness value by a total of 50 of 20+10+10+10, thereby changing 255 to 205. The electronic device may decrease the brightness of the pixels having the brightness values from 0 to 255 to the brightness value from 0 to 255 by the specified ratio. According to various embodiments of the present disclosure, the electronic device (for example, processor or DDI) may determine a ratio of decreasing brightness depending on the number of satisfied conditions among the plurality of conditions or what the satisfied conditions are.

According to one embodiment of the present disclosure, the electronic device (for example, processor or DDI) may decrease brightness of some of the pixels of the content depending on the specified ratio. For example, the electronic device may decrease the brightness for each block depending on the specified ratio.

According to one embodiment of the present disclosure, the electronic device (for example, processor or DDI) may decrease the brightness of some of the pixels (or pixels included in some of the blocks) depending on the specified reference. For example, the electronic device may decrease the brightness of the pixels (or, pixels included in the block having the average brightness value that is equal to or more the specified reference adjustment value) having the brightness value that is equal to or more than the specified reference adjustment value depending on the specified ratio.

According to one embodiment of the present disclosure, the electronic device (for example, processor or DDI) may gradually change the brightness of the content in the plurality of frame sections when adjusting the brightness of the content. For example, to prevent the dazzling, the electronic device repeatedly makes a content image bright and dark when the brightness of the content is suddenly changed in each frame section, thereby rather hindering a user from watching content. According to one embodiment of the present disclosure, the electronic device gradually changes the brightness of the pixels of the frame of the content to a targeted brightness value when changing the brightness of the pixels of the frame of the content, thereby preventing dazzling without hindering the user from watching the content. According to various embodiments of the present disclosure, the electronic device (for example, processor or DDI) may variously set or change how much the brightness is changed, the time when the brightness is changed, or the like depending on the input of the user.

According to one embodiment of the present disclosure, the electronic device (for example, processor or DDI) may change the brightness value of the pixel if the difference between a current brightness value of the pixel and the targeted brightness value to be finally changed is equal to or more than the specified value when the brightness of the pixel is changed. For example, the electronic device (for example, processor or DDI) may change the brightness only when the difference between the current average brightness value of the block and the targeted brightness value of the block to be changed is equal to or more than the specified value to prevent the brightness from being too frequently changed.

According various embodiments of the present disclosure, the electronic device (for example, processor or DDI) may increase or decrease the brightness of the content as needed by using the above-mentioned principle.

Figure 10:
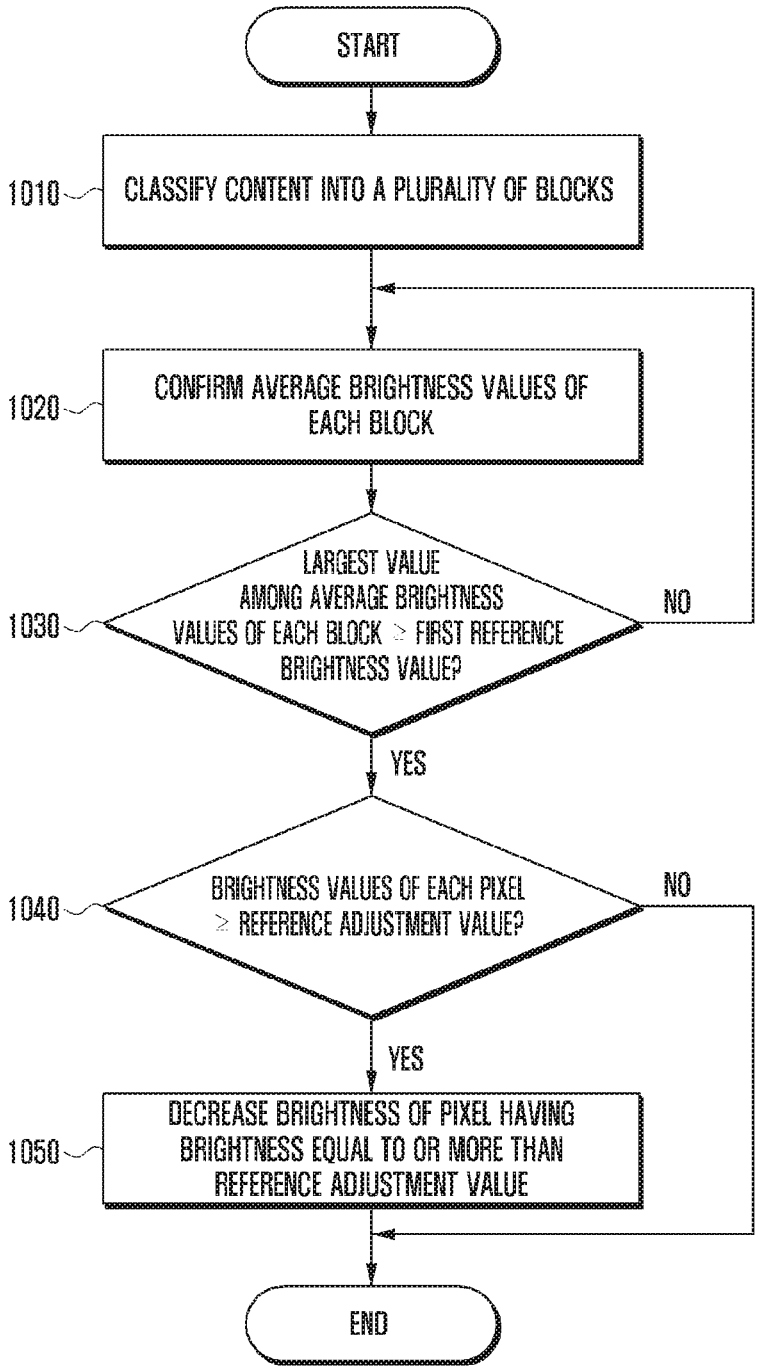
FIG. 10 is a flow chart illustrating the method for displaying content of an electronic device according to various embodiments of the present disclosure.

FIG. 10 is a flow chart illustrating the method for displaying content of an electronic device according to various embodiments of the present disclosure.

In operation 1010, the electronic device (for example, processor or display driver IC (DDI)) may classify content into a plurality of blocks. For example, the electronic device (for example, processor or DDI) may classify the frame into the plurality of blocks including at least one pixel, every frame during the reproduction of content. According to one embodiment of the present disclosure, the electronic (for example, processor or DDI) may measure illumination around the electronic device prior to classifying content. According to one embodiment of the present disclosure, the electronic (for example, processor or DDI) may adjust the brightness of the content to prevent dazzling from occurring only at low illumination environment.

In operation 1020, the electronic device (for example, processor or DDI) may confirm the average brightness values of each block. For example, the electronic device may confirm the brightness of at least one pixel included in each block every frame of content and calculate the average brightness values of each block.

In operation 1030, the electronic device (for example, processor or DDI) may determine whether the highest value among the average brightness values of each block is equal to or more than the specified first reference brightness value. The electronic device may adjust brightness of content when the highest value among the average brightness values of each block is equal to or more than the specified first reference brightness value. The electronic device may perform operation 1040 to adjust the brightness when the highest value among the average brightness values of each block is equal to or more than the specified first reference brightness value. The electronic device may perform the operation 1020 when the highest value among the average brightness values of each block is less than the specified first reference brightness value.

In the operation 1040, the electronic device (for example, processor or DDI) may determine whether the brightness values of each pixel are equal to or more than the specified reference adjustment value. For example, the electronic device may confirm the brightness values of each pixel. The electronic device may recognize a high-brightness pixel having brightness that is equal to or more than the specified reference adjustment value.

In operation 1050, the electronic device (for example, processor or DDI) may decrease the brightness of the pixel having the brightness equal to or more than the reference adjustment value. For example, the electronic device may decrease the brightness for the pixel depending on the specified ratio. According to an embodiment of the present disclosure, the electronic device (for example, processor or DDI) may decrease only the brightness of the high-brightness pixel equal to or more than the specified reference adjustment value when adjusting the brightness of the content. According to one embodiment of the present disclosure, the electronic device (for example, processor or DDI) may adjust only the brightness of the high-brightness pixel, thereby minimizing the disharmony of the user who watches content.

According to various embodiments of the present disclosure, the electronic device (for example, processor or DDI) may also adjust the brightness (for example, brightness of all the pixels) of the content uniformly, instead of performing the operations 1040 and 1050. For example, the electronic device (for example, processor or DDI) may also decrease the brightness of all the pixels uniformly without comparing the brightness values of each pixel with the reference adjustment value.

According various embodiments of the present disclosure, the electronic device (for example, processor or DDI) may increase or decrease the brightness of content as needed by using the above-mentioned principle.

Figure 11:
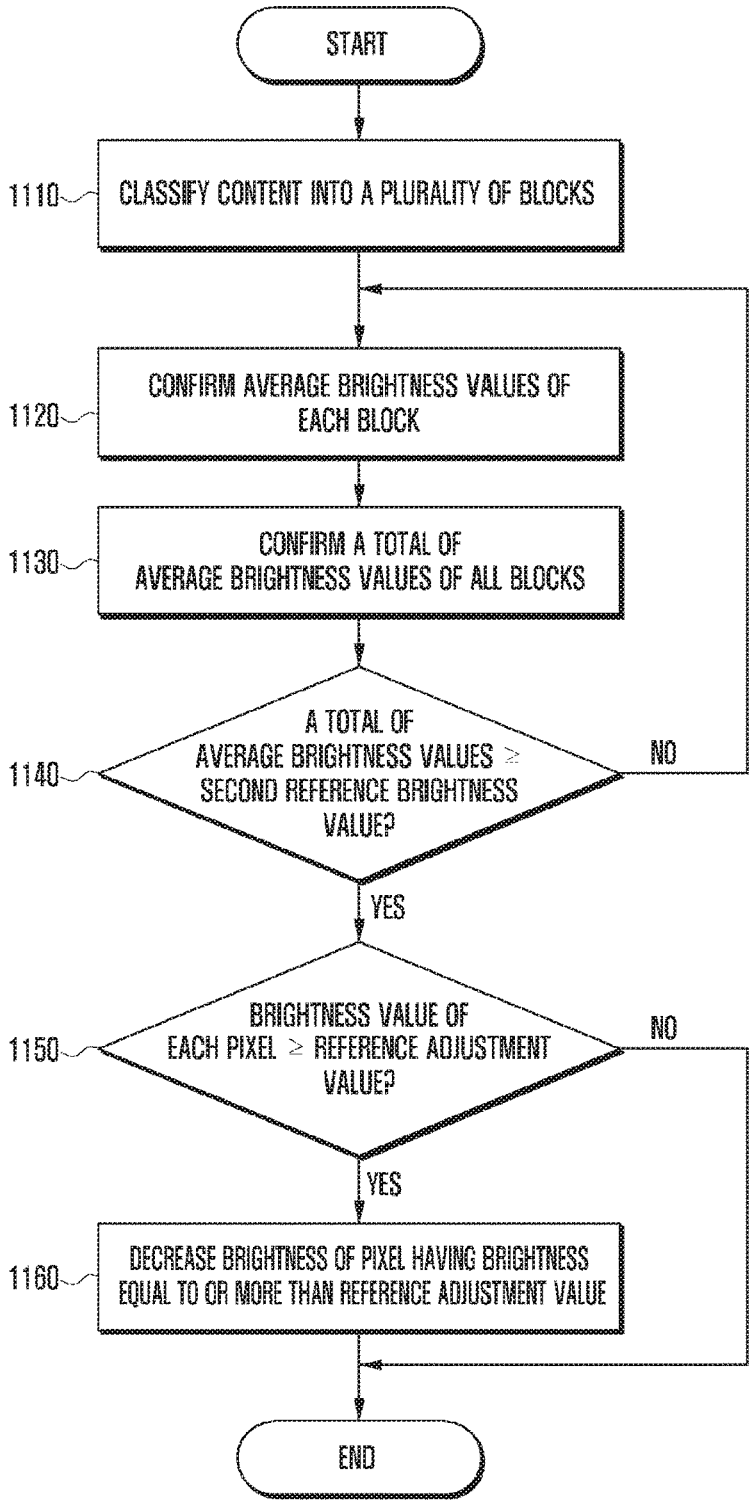
FIG. 11 is a flow chart illustrating the method for displaying content of an electronic device according to various embodiments of the present disclosure.

FIG. 11 is a flow chart illustrating the method for displaying content of an electronic device according to various embodiments of the present disclosure.

In operation 1110, the electronic device (for example, processor or display driver IC (DDI)) may classify content into a plurality of blocks. For example, the electronic device (for example, processor or DDI) may classify the frame into the plurality of blocks including at least one pixel, every frame during the reproduction of content. According to one embodiment of the present disclosure, the electronic (for example, processor or DDI) may adjust the brightness of the content to prevent dazzling from occurring only at low illumination environment.

In operation 1120, the electronic device (for example, processor or DDI) may confirm the average brightness values of each block. For example, the electronic device may confirm the brightness of at least one pixel included in each block every frame of content and calculate the average brightness values of each block.

In operation 1130, the electronic device (for example, processor or DDI) may confirm the total of average brightness values of all the blocks. For example, the electronic device may confirm the total of average brightness values of all contents. For example, the electronic device may calculate the average of the average brightness values of each block.

According to various embodiments of the present disclosure, the electronic device (for example, processor or DDI) may omit operations 1110 and 1120 when comparing the total of average brightness values of all contents with the specified second reference brightness value without determining other conditions.

In operation 1140, the electronic device (for example, processor or DDI) may determine whether the total of average brightness values is equal to or more than the specified second reference brightness value. The electronic device (for example, processor or DDI) may perform operation 1150 whether the total of average brightness values is equal to or more than the specified second reference brightness value. For example, the electronic device (for example, processor or DDI) may adjust the brightness of the pixel when the total of average brightness values is equal to or more than the specified second reference brightness value. The electronic device (for example, processor or DDI) may perform the operation 1120 or 1130 when total of average brightness values is less than the specified second reference brightness value.

In the operation 1150, the electronic device (for example, processor or DDI) may determine whether the brightness values of each pixel are equal to or more than the specified reference adjustment value. For example, the electronic device (for example, processor or DDI) may confirm the brightness values of each pixel. The electronic device (for example, processor or DDI) may recognize the high-brightness pixel having brightness that is equal to or more than the specified reference adjustment value.

In operation 1160, the electronic device (for example, processor or DDI) may decrease the brightness of the pixel having the brightness equal to or more than the reference adjustment value. For example, the electronic device (for example, processor or DDI) may decrease the brightness of the pixel depending on the specified ratio. According to one embodiment of the present disclosure, the electronic device (for example, processor or DDI) may decrease only the brightness of the high-brightness pixel equal to or more than the specified reference adjustment value when adjusting the brightness of the content.

According to one embodiment of the present disclosure, the electronic device (for example, processor or DDI) may also decrease the brightness of all the pixels uniformly without comparing the brightness values of each pixel with the reference adjustment value.

According various embodiments of the present disclosure, the electronic device (for example, processor or DDI) may increase or decrease the brightness of content as needed by using the above-mentioned principle.

Figure 12:
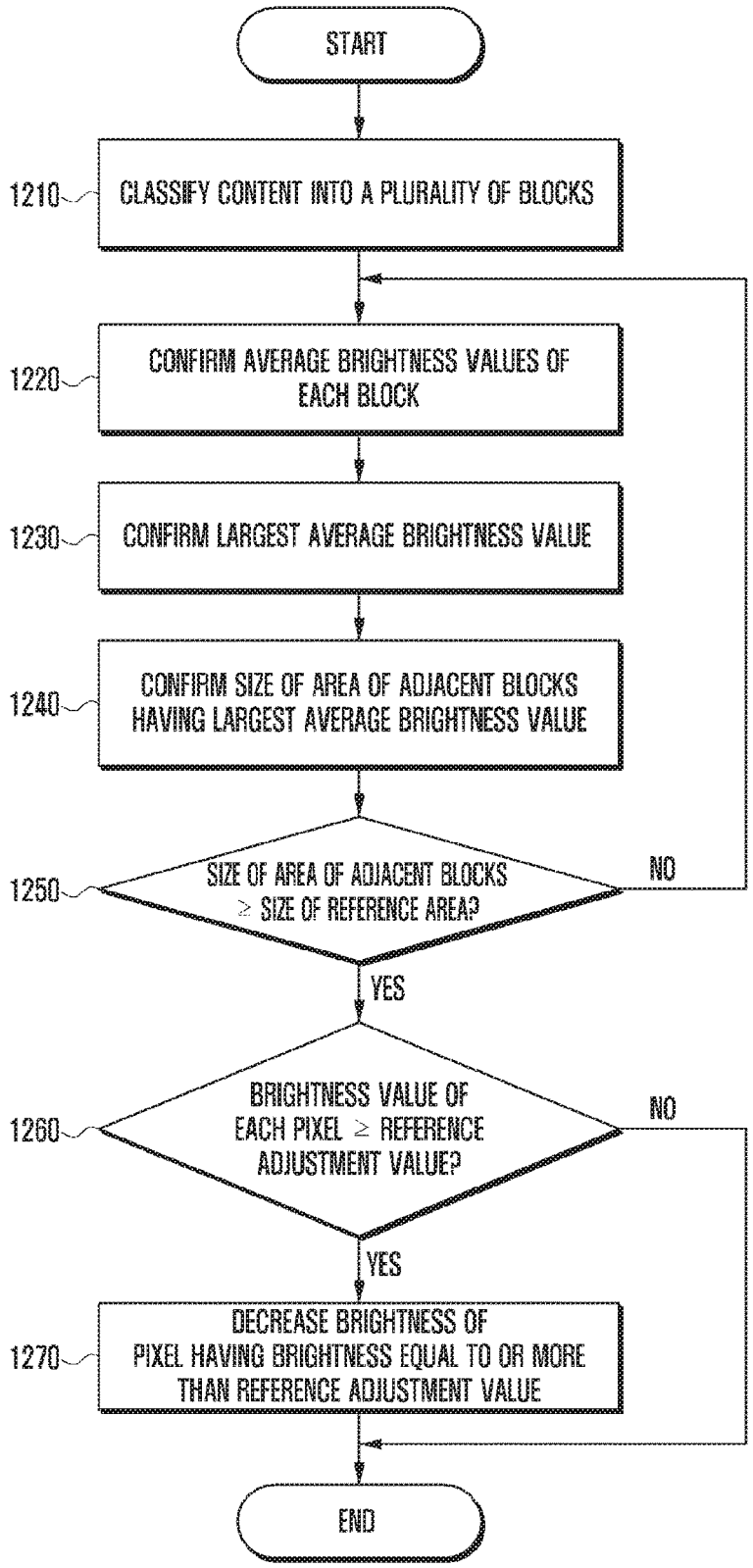
FIG. 12 is a flow chart illustrating a method for displaying content of an electronic device according to various embodiments of the present disclosure.

FIG. 12 is a flow chart of a method for displaying content of an electronic device according to various embodiments of the present disclosure.

In operation 1210, the electronic device (for example, processor or display driver IC (DDI)) may classify content into a plurality of blocks. For example, the electronic device (for example, processor or DDI) may classify the frame into the plurality of blocks including at least one pixel, every frame during the reproduction of content. According to one embodiment of the present disclosure, the electronic (for example, processor or DDI) may adjust the brightness of the content to prevent dazzling from occurring only at low illumination environment.

In operation 1220, the electronic device (for example, processor or DDI) may confirm the average brightness values of each block. For example, the electronic device may confirm the brightness of at least one pixel included in each block every frame of content and calculate the average brightness values of each block.

In operation 1230, the electronic device (for example, processor or DDI) may confirm the highest average brightness value. For example, the electronic device may confirm the blocks having the highest average brightness value.

In operation 1240, the electronic device (for example, processor or DDI) may confirm the size of the area of the adjacent blocks having the highest average brightness value. For example, the electronic device may confirm whether the blocks having the highest average brightness value are adjacent to each other. For example, the electronic device may confirm whether the blocks having the highest average brightness value are disposed while contacting the respective surfaces of up, down, left, and right sides to each other. The electronic device may confirm the size of the area of the adjacent blocks having the highest average brightness value. For example, the electronic device may confirm the size of the largest area among the areas of the adjacent blocks having the highest average brightness value.

In operation 1250, the electronic device (for example, processor or DDI) may confirm whether the size of the area of the adjacent blocks having the highest average brightness value is equal to or more than that of the specified reference area. For example, the electronic device may perform operation 1260 when the size of the area of the adjacent blocks having the highest average brightness value is equal to or more than that of the specified reference area. The electronic device may perform the operation 1220 when the size of the area of the adjacent blocks having the highest average brightness value is less than that of the specified reference area.

In the operation 1260, the electronic device (for example, processor or DDI) may determine whether the brightness values of each pixel are equal to or more than the specified reference adjustment value. For example, the electronic device may confirm the brightness values of each pixel. The electronic device may recognize a high-brightness pixel having brightness that is equal to or more than the specified reference adjustment value.

In operation 1270, the electronic device (for example, processor or DDI) may decrease the brightness of the pixel having the brightness equal to or more than the reference adjustment value. For example, the electronic device may decrease the brightness for the pixel depending on the specified ratio. According to one embodiment of the present disclosure, the electronic device (for example, processor or DDI) may decrease only the brightness of the high-brightness pixel equal to or more than the specified reference adjustment value when adjusting the brightness of the content.

According to one embodiment of the present disclosure, the electronic device (for example, processor or DDI) may also decrease the brightness of all the pixels uniformly without comparing the brightness values of each pixel with the reference adjustment value.

According various embodiments of the present disclosure, the electronic device (for example, processor or DDI) may increase or decrease the brightness of content as needed by using the above-mentioned principle.

Figure 13:
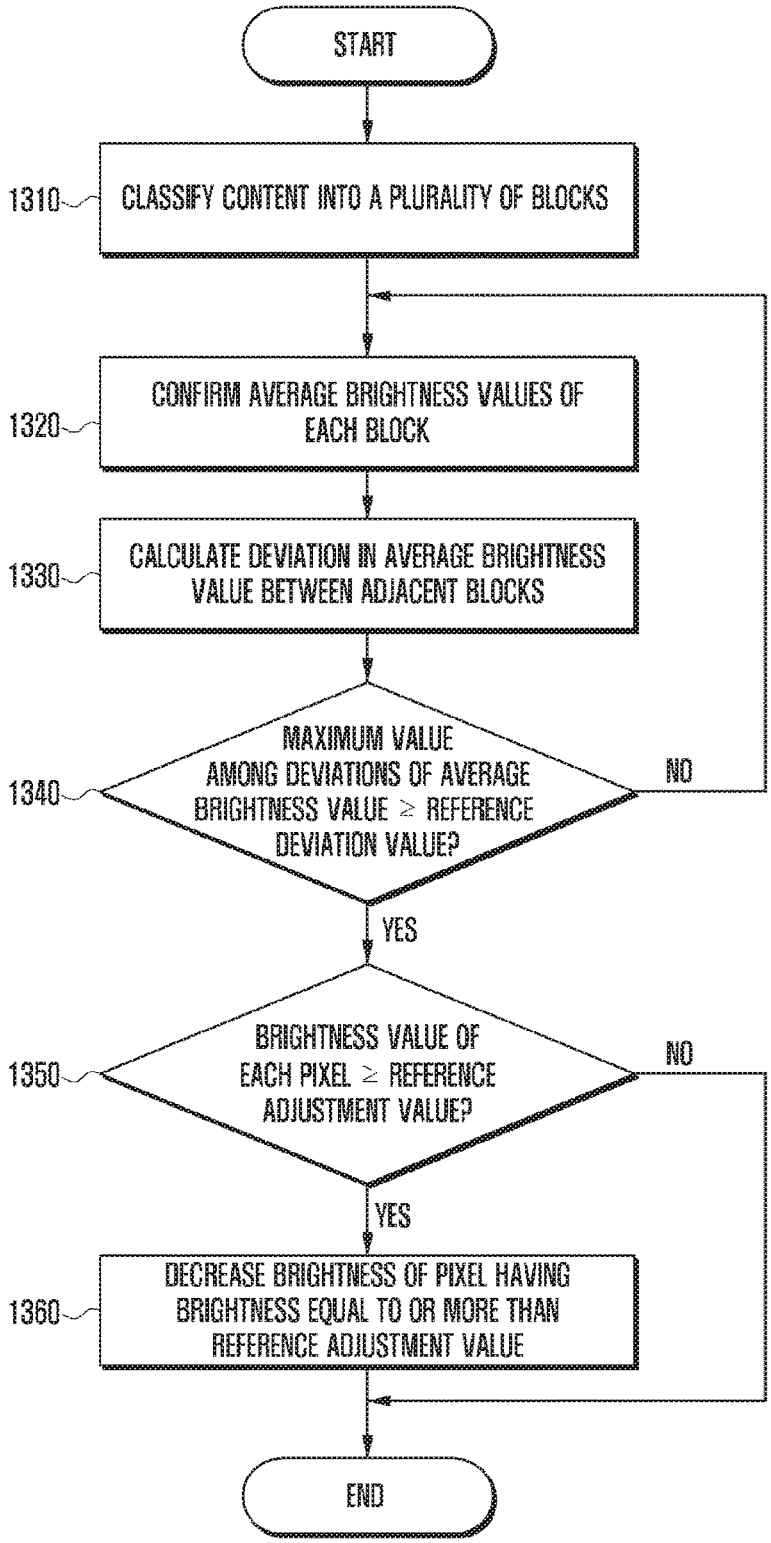
FIG. 13 is a flow chart illustrating the method for displaying content of an electronic device according to various embodiments of the present disclosure.

FIG. 13 is a flow chart illustrating the method for displaying content of an electronic device according to various embodiments of the present disclosure.

In operation 1310, the electronic device (for example, processor or display driver IC (DDI)) may classify content into a plurality of blocks. For example, the electronic device may classify the frame into the plurality of blocks including at least one pixel, every frame during the reproduction of content. According to one embodiment of the present disclosure, the electronic (for example, processor or DDI) may adjust the brightness of the content to prevent dazzling from occurring only at low illumination environment.

In operation 1320, the electronic device (for example, processor or DDI) may confirm the average brightness values of each block. For example, the electronic device may confirm the brightness of at least one pixel included in each block every frame of content and calculate the average brightness values of each block.

In operation 1330, the electronic device (for example, processor or DDI) may calculate the deviation in the average brightness values between the adjacent blocks. For example, the electronic device may calculate the deviations in the average brightness values of adjacent blocks located at up, down, left, and right sides or a diagonal line with respect to each block.

In operation 1340, the electronic device (for example, processor or DDI) may determine whether the maximum value among the deviations in the average brightness values is equal to or more than the specified reference deviation value. According to one embodiment of the present disclosure, the electronic device may confirm the maximum value among the deviations in the average brightness values between the blocks. For example, even though the total of average brightness values of the content is the same, when the deviations in the average brightness values between the respective blocks are severe, the dazzling of the user may be severer. The electronic device may perform the operation 1350 when the deviation in the average brightness value is equal to or more than the specified reference deviation value. The electronic device may perform the operation 1320 when the deviation in the average brightness value is less than the specified reference deviation value.

For example, the electronic device (for example, processor or DDI) may sense when the difference in the brightness between the blocks is large to adjust the brightness of the pixel in operations under the operation 1350.

In the operation 1350, the electronic device (for example, processor or DDI) may determine whether the brightness values of each pixel are equal to or more than the specified reference adjustment value. For example, the electronic device may confirm the brightness values of each pixel. The electronic device may recognize a high-brightness pixel having brightness that is equal to or more than the specified reference adjustment value.

In operation 1360, the electronic device (for example, processor or DDI) may decrease the brightness of the pixel having the brightness equal to or more than the reference adjustment value. For example, the electronic device may decrease the brightness for the pixel depending on the specified ratio. According to one embodiment of the present disclosure, the electronic device (for example, processor or DDI) may decrease only the brightness of the high-brightness pixel equal to or more than the specified reference adjustment value when adjusting the brightness of the content.

According to one embodiment of the present disclosure, the electronic device (for example, processor or DDI) may also decrease the brightness of all the pixels uniformly without comparing the brightness values of each pixel with the reference adjustment value.

According to various embodiments of the present disclosure, the electronic device (for example, processor or DDI) may adjust the brightness of the pixel when satisfying the condition that at least one of the size of the adjacent blocks having the highest value among the average brightness values of each block described with reference to FIGS. 10 to 13, the total of average brightness values, and the highest average brightness value and the maximum value among the deviations of the average brightness values is equal to or more than the corresponding specified value. According to various embodiments of the present disclosure, the electronic device (for example, processor or DDI) may differently determine the ratio of adjusting the brightness of the pixel depending on the number of satisfied conditions or what condition it satisfies.

According various embodiments of the present disclosure, the electronic device (for example, processor or DDI) may increase or decrease the brightness of content as needed by using the above-mentioned principle.

Figure 14:
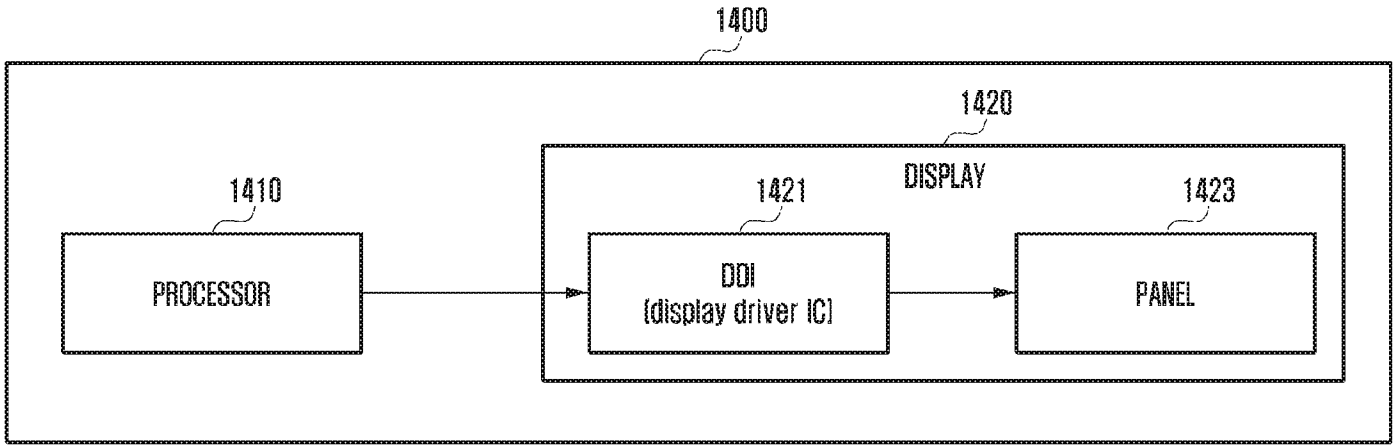
FIG. 14 is a block diagram illustrating an electronic device according to various embodiments of the present disclosure.

FIG. 14 is a block diagram of an electric device 1400 according to various embodiments of the present disclosure.

According to one embodiment of the present disclosure, the electronic device 1400 may include a processor 1410 and a display.

The processor 1410 may drive, for example, an operating system or an application program to control a plurality of hardware or software components connected to the processor 1410 and may perform various data processings and operations. According to one embodiment of the present disclosure, the processor 1410 may control a display (for example, display driver IC (DDI) 1421 or panel 1423). The processor 1410 may load a command or data received from at least one of other components (for example: non-volatile memory) in a volatile memory and process it and may store the result data in the non-volatile memory. According to one embodiment of the present disclosure, the processor 1410 may be the processors 1410 and 210 illustrated in FIG. 2.

According to one embodiment of the present disclosure, the display may include the display driver IC 1421 and the panel 1423.

The DDI 1421 may control the brightness of the content that is being displayed on the panel 1423 under the control of the processor 1410 or independently. For example, the DDI 1421 may classify the content that is being displayed on the panel 1423 into the plurality of blocks. According to one embodiment of the present disclosure, the DDI 1421 may confirm the average brightness values of each block.

According to one embodiment of the present disclosure, the DDI 1421 may adjust the brightness of the content when satisfying the condition that at least one of the highest value among the average brightness values of each block, the total of average brightness values of all the blocks, the size (maximum value) of the area of the adjacent blocks having the highest average brightness value, and the maximum value among the deviations in the average brightness value of each block is equal to or more than the corresponding specified reference value. According to various embodiments of the present disclosure, the DDI may differently determine the ratio of adjusting the brightness of the pixel depending on the number of satisfied conditions or what condition it satisfies.

According to one embodiment of the present disclosure, the DDI 1421 may decrease the brightness of at least one pixel depending on the specified ratio when satisfying at least one condition. According to one embodiment of the present disclosure, the DDI 1421 may uniformly decrease the brightness of all the pixels when adjusting the brightness of the content. According to one embodiment of the present disclosure, the DDI 1421 may uniformly decrease the brightness of at least some of the pixels when adjusting the brightness of the content. For example, the DDI 1421 may selectively decrease the brightness of the high-brightness pixel that is equal to or more the specified reference adjustment value among all the pixels.

The panel 1423 may display content. According to one embodiment of the present disclosure, the panel 1423 may change and display the output brightness of the content that is being displayed under the control of the DDI 1421. For example, the panel 1423 may decrease or increase the output brightness of the content that is being displayed under the control of the DDI 1421.

According various embodiments of the present disclosure, the electronic device 1400 (for example, DDI 1421) may increase or decrease the brightness of content that is being displayed on the panel 1423 as needed by using the above-mentioned principle.

According to various embodiments of the present disclosure, the electronic device 1400 may further include all or some of the components illustrated in FIGS. 1 to 3.

A method for displaying an electronic device according to various embodiments of the present disclosure, the processor may include an operation of classifying a frame of content that is being reproduced on the display into a plurality of blocks including at least one pixel, an operation of confirming average brightness values of each of the plurality of blocks, an operation of determining whether to satisfy at least one specified condition based on the average brightness values of the plurality of blocks, and an operation of adjusting brightness of at least one pixel included in the plurality of blocks if it is determined that the at least one specified condition is satisfied.

According to one embodiment of the present disclosure, the method may further include an operation of measuring illumination around the electronic device. According to on embodiment of the present disclosure, when the measured illumination is equal to or less tan the reference illumination value, the method may further include an operation of adjusting the brightness of the at least one pixel.

According to one embodiment of the present disclosure, the operation of the adjusting may include the operation of adjusting the brightness of the at least one pixel based on the condition that the average brightness value of at least one of the plurality of blocks satisfies the specified first condition. For example, the first condition may include the condition that the largest average brightness value among the average brightness values of the blocks is equal to or more than the specified first reference brightness value.

According to one embodiment of the present disclosure, the operation of the adjusting may include the operation of adjusting the brightness of the at least one pixel based on the condition that the total of average brightness values of all the plurality of blocks satisfies the specified second condition. For example, the second condition may include the condition that the total of average brightness values of all the plurality of blocks is equal to or more than the specified second reference brightness value.

According to one embodiment of the present disclosure, the operation of determining whether to satisfy the condition may include an operation of confirming the size of the area formed by contacting at least one block having the largest average brightness value among the plurality of blocks to each other and an operation of determining whether the size of the formed area is equal to or more than that of the specified reference area.

According to one embodiment of the present disclosure, the operation of determining whether to satisfy the condition may include an operation of calculating the deviations in the average brightness values of the adjacent blocks in each of the plurality of blocks and an operation of determining whether the largest value among the deviations in the average brightness values of each of the plurality of blocks is equal to or more than the reference deviation value.

According to one embodiment of the present disclosure, the operation of adjusting the brightness of the pixel may include an operation of recognizing a pixel whose brightness value is equal to or more than a specified reference adjustment value among the at least one pixel and an operation of decreasing brightness of the recognized pixel.

According to one embodiment of the present disclosure, the operation of adjusting the brightness of the pixel may include an operation of decreasing the brightness of the at least one pixel depending on the specified ratio.

According to one embodiment of the present disclosure, the method may include an operation of gradually changing the brightness of the at least one pixel in a plurality of frame sections of content.

According to one embodiment of the present disclosure, the method may be include an operation of determining a ratio to decrease the brightness of the at least one pixel depending on the at least one condition.

The term used in the present document "module" may include a unit configured in hardware, software, or firmware and may be interchangeably used with terms such as logic, a logic block, a part, and a circuit. The "module" may be an integrally configured part or a minimum unit performing at least one function or a part thereof. The "module" may be mechanically or electronically implemented, and may include, for example, an application-specific integrated circuit (ASIC) chip, field-programmable gate arrays (FPGAs), a programmable logic device, or the like, which are already known or will be developed in the future, for performing any operations. At least some of the devices (for example: modules or functions thereof) or the methods (for example: operations) according to various embodiments may be implemented as commands stored in a computer readable storage medium (for example: memory 130) in a form or a program module. When the command is executed by the processor (for example: processor 120), the processor may perform a function corresponding to the command. The computer readable recording medium may include a hard disk, a floppy disk, a magnetic medium (for example, magnetic tape), an optical recording medium (for example, CD-ROM, DVD, magnetic-optical medium (for example: floptical disk), an internal memory, or the like. The command may include a code made by a compiler or a code that may be executed by an interpreter.

According to one embodiment of the present disclosure, in the computer readable recording medium, the recording medium is recorded with at least one program including commands, in which when being executed by at least one processor, the commands may be configured to perform the operations of allowing the electronic device to classify the frame of content that is being reproduced on the display into the plurality of blocks including at least one pixel, confirm the average brightness values of each of the plurality of blocks, determine whether to satisfy at least one specified condition based on the average brightness values of the plurality of blocks, and adjust the brightness of at least one pixel included in the plurality of blocks if it is determined that the at least one specified condition is satisfied.

The module or the program module according to various embodiments may include at least one of the above-mentioned components, may not include some thereof, or may further include other components. According to various embodiments, the operations performed by the module, the program module, or other components may be performed sequentially, in parallel, repeatedly, or heuristically, at least of the operations may be executed in another order or omitted, or other operations may be added.

Although the present disclosure has been described with various exemplary embodiments, various changes and modifications may be suggested to one skilled in the art. It is intended that the present disclosure encompass such changes and modifications as fall within the scope of the appended claims.

What is claimed is:

1. An electronic device, comprising:

a display; and a processor electrically connected to the display, wherein the processor is configured to:

classify a frame of content that is being reproduced on the display into a plurality of blocks including at least one pixel, confirm average brightness values of each of the plurality of blocks, determine whether to satisfy at least one specified condition based on the average brightness values of at least some of the plurality of blocks, and adjust brightness of the at least one pixel included in the plurality of blocks if it is determined that the at least one specified condition is satisfied when a measured illumination around the electronic device is equal to or less than a specified reference illumination value.

2. The electronic device of claim 1, wherein the processor is configured to adjust the brightness of the at least one pixel when an average brightness value of at least one of the plurality of blocks is equal to or greater than a specified first reference brightness value.

3. The electronic device of claim 1, wherein the processor is configured to adjust the brightness of the at least one pixel when a total of average brightness values of all of the plurality of blocks is equal to or greater than a specified second reference brightness value.

4. The electronic device of claim 1, wherein the processor is configured to:

confirm a size of an area formed by contacting at least one block of the plurality of blocks to the each of the plurality of blocks remaining, the at least one block having a largest average brightness value among the each of the plurality of blocks; and adjust the brightness of the at least one pixel when the size of the formed area is equal to or greater than that of a specified reference area.

5. The electronic device of claim 1, wherein the processor is configured to:

calculate deviations in the average brightness values of adjacent blocks of the each of the plurality of blocks; and adjust the brightness of the at least one pixel when a largest value among the deviations in the average brightness values of the adjacent blocks of the each of the plurality of blocks is equal to or greater than a reference deviation value.

6. The electronic device of claim 1, wherein the processor is configured to:

recognize a first pixel of the at least one pixel having a brightness value equal to or greater than a specified reference adjustment value; and decrease brightness of the recognized first pixel.

7. The electronic device of claim 1, wherein the processor is configured to adjust the brightness of the at least one pixel depending on a specified ratio.

8. The electronic device of claim 1, wherein the processor is configured to:

classify the frame of content that is being reproduced on the display into a plurality of frame sections including the at least one pixel; and gradually change the brightness of the at least one pixel in the plurality of frame sections.

9. The electronic device of claim 1, wherein the processor is configured to determine a ratio for adjusting the brightness of the at least one pixel depending on the at least one specified condition.

10. A method for displaying content of an electronic device, comprising:

classifying a frame of content that is being reproduced on a display into a plurality of blocks including at least one pixel;

confirming average brightness values of each of the plurality of blocks;

determining whether to satisfy at least one specified condition based on the average brightness values of the each of the plurality of blocks; and adjusting brightness of the at least one pixel included in the plurality of blocks if it is determined that the at least one specified condition is satisfied when a measured illumination around the electronic device is equal to or less than a specified reference illumination value.

11. The method of claim 10, further comprising adjusting the brightness of the at least one pixel based on an average brightness value of at least one of the plurality of blocks satisfying a first specified condition of the at least one specified condition.

12. The method of claim 10, wherein adjusting the brightness of the at least one pixel comprises adjusting the brightness based on a total of average brightness values of all of the plurality of blocks satisfying a second specified condition of the at least one specified condition.

13. The method of claim 10, wherein determining whether to satisfy the at least one specified condition comprises:

confirming a size of an area formed by contacting at least one block of the plurality of blocks to the each of the plurality of blocks remaining, the at least one block having a largest average brightness value among the each of the plurality of blocks; and determining whether the size of the formed area is equal to or greater than that of a specified reference area.

14. The method of claim 10, wherein determining whether to satisfy the at least one specified condition includes:

calculating deviations in the average brightness values of adjacent blocks of the each of the plurality of blocks; and determining whether a largest value among the deviations in the average brightness values of the adjacent blocks of the each of the plurality of blocks is equal to or greater than a reference deviation value.

15. The method of claim 10, wherein adjusting the brightness of the at least one pixel includes:

recognizing a first pixel of the at least one pixel having a brightness value equal to or greater than a specified reference adjustment value; and decreasing brightness of the recognized first pixel.

16. The method of claim 10, wherein adjusting the brightness of the at least one pixel includes decreasing the brightness of the at least one pixel depending on a specified ratio.

17. The method of claim 10, further comprising:

classifying the frame of content that is being reproduced on the display into a plurality of frame sections including the at least one pixel; and gradually changing the brightness of the at least one pixel in the plurality of frame sections.

18. The method of claim 10, further comprising:

determining a ratio for decreasing the brightness of the at least one pixel depending on the at least one specified condition.

19. An electronic device, comprising:

a display including a display driver (DDI) integrated circuit (IC) and a panel; and a processor electrically connected to the display, wherein the DDI is configured to:

classify a frame of content that is being reproduced on the panel into a plurality of blocks including at least one pixel, confirm average brightness values of each of the plurality of blocks, determine whether to satisfy at least one specified condition based on the average brightness values of the each of the plurality of blocks, and adjust brightness of the at least one pixel included in the plurality of blocks if it is determined that the at least one specified condition is satisfied when a measured illumination around the electronic device is equal to or less than a specified reference illumination value.

20. A non-transitory computer readable medium comprising at least one program including commands, wherein when the commands are executed by at least one processor, an electronic device is configured to perform operations of:

classifying a frame of content that is being reproduced on a display into a plurality of blocks including at least one pixel;

confirming average brightness values of each of the plurality of blocks;

determining whether to satisfy at least one specified condition based on the average brightness values of the each of the plurality of blocks; and adjusting brightness of the at least one pixel included in the plurality of blocks if it is determined that the at least one specified condition is satisfied when a measured illumination around the electronic device is equal to or less than a specified reference illumination value.

* * * * *